United States Patent [19]

Murata et al.

[11] Patent Number: 4,609,283

[45] Date of Patent: Sep. 2, 1986

[54] COPYING APPARATUS WITH PREPROGRAMMED FEATURES ENABLED BY A DOCUMENT

[75] Inventors: Tomoji Murata; Masazumi Ito, both of Toyohashi, Japan

[73] Assignee: Minolta Camera Kabushiki Kaisha, Osaka, Japan

[21] Appl. No.: 686,281

[22] Filed: Dec. 26, 1984

[30] Foreign Application Priority Data

Dec. 26, 1983 [JP] Japan ..... 58-248637

[51] Int. Cl.[4] ..... G03G 15/00

[52] U.S. Cl. ..... 355/14 R; 355/14 SH; 355/14 C; 355/3 SH

[58] Field of Search ..... 355/14 R, 14 SH, 3 R, 355/14 C, 14 CV, 6, 3 SH, 14 E

[56] References Cited

U.S. PATENT DOCUMENTS

| | | | |
|---|---|---|---|
| 4,014,609 | 3/1977 | VerSchage et al. | 355/14 R |
| 4,099,860 | 7/1978 | Connin | 355/14 R X |
| 4,192,607 | 3/1980 | Hage | 355/14 SH X |
| 4,215,930 | 8/1980 | Miyakawa et al. | 355/14 E X |
| 4,248,528 | 2/1981 | Sahay | 355/6 X |
| 4,361,393 | 11/1982 | Noto | 355/3 SH |
| 4,462,681 | 7/1984 | Aerts et al. | 355/14 SH |

FOREIGN PATENT DOCUMENTS 57-181559 11/1982 Japan .

*Primary Examiner*—A. C. Prescott

*Attorney, Agent, or Firm*—Price, Gess & Ubell

[57] ABSTRACT

An improved copying apparatus is provided having a control panel that can be enabled for subjectively programming of copying functions while displaying the same to the user. The user can then store his composed program in correlation with a specific code indicia. The coded indicia can then be placed on a document and inserted into the copying machine with the code indicia sensed. Upon sensing the code indicia, the prestored copier function program is enabled to provide the desired copying operation. Self-correction of magnification ratios in the program data and control of a paper sorter bin can be used with the copier apparatus.

8 Claims, 37 Drawing Figures

COPYING APPARATUS WITH PREPROGRAMMED FEATURES ENABLED BY A DOCUMENT

BACKGROUND OF THE INVENTION

The present invention generally relates to a copying arrangement and more particularly, to a copying apparatus provided with a mode reserving function.

The mode reserving function in a copying apparatus as referred to above means such a function that enables a particular operator to preliminarily set in the copying apparatus, the number of sheets to be copied, copying magnifications, density, and size of copying sheets, etc. which are required when the operator actually effects his copying, even when another operator is using said copying apparatus. In many cases, in a copying apparatus associated with an automatic original document feeding device (referred to as an ADF unit hereinafter), the above function is combined for application with another function which makes it possible to transport an original document of the particular operator subsequent to the original document of another operator. In the above case, an automatic changeover of the copying mode is required by checking that the copying of the original document for another operator has been completed, and for this purpose, there have conventionally been proposed such systems as follows.

(i) A system in which the number of original documents is preset besides the number of sheets to be copied (number of copies) for change-over of the mode upon termination of the number of original documents.

(ii) Another system in which a special sheet is placed on a first sheet of the original documents for each of the operators so as to enable the automatic original document feeding unit to read a mark affixed on the special sheet for judgement of change-over of the original document.

However, in the above system (i) as disclosed in U.S. Pat. No. 4,014,609, it is necessary to preset the number of original documents to be copied by the designated mode, when the copying function is to be effected with respect to a large number of original documents, thus involving such troublesome procedures that the number of the original documents must be counted each time.

Meanwhile, in the above known system (ii) as disclosed in Japanese Patent Laid-open Publication Tokkaisho No. 57-181559, data representing the copying execution mode as referred to above are written in a data sheet, for example, by painting out the mark so that the ADF unit reads the data for discrimination between the data for starting a new mode and the data for various set conditions. However, in the actual application, the work involved for writing in the data sheet is considerably troublesome, while the reading mechanism of the ADF unit is complicated thereby, thus presenting a serious problem in the actual use.

SUMMARY OF THE INVENTION

Accordingly, an essential object of the present invention is to provide an improved copying apparatus which is arranged to be capable of effecting a mode reservation through simple procedures, with substantial elimination of disadvantages inherent in the conventional copying apparatuses of this kind. Another important object of the present invention is to provide a copying apparatus of the above described type which is simple in construction and stable in functioning at high reliability.

According to the present invention, the data sheet is to be marked with an identification mark for judgement of a code for a particular operator, while actual data to be set for the mode reservation of the copying function are arranged to be input through utilization of keys provided on a control panel of the copying apparatus.

More specifically, in accomplishing these and other objects, according to one preferred embodiment of the present invention, there is provided a copying apparatus on which an automatic original document feeding device can be mounted for copying an original document supplied by the automatic original document feeding device in association with functioning of said automatic original document feeding device, and which includes an original document identification sheet marked with an identification symbol and capable of being transported by the automatic original document feeding device, a sensor provided on the automatic original document feeding device for reading the identification symbol marked on the original document identification sheet, means for judging a code indicated by the identification mark based on a signal read by the sensor, a memory means for storing a plurality of sets of data, each including data corresponding to the code and functioning mode data set for execution of the copying functioning, an operating means for inputting the code into the memory means, another operating means for inputting the functioning mode data into said memory means, and a control means arranged to control the copying apparatus in such a manner that, during execution of the copying functioning, when the original document identification sheet is transported by the automatic original document feeding device so that the identification symbol is read, with the code corresponding to the identification symbol being judged by the judging means, the control means reads the functioning mode data stored together with the code from the memory means for controlling the copying apparatus so as to execute the copying function based on the read data with respect to the original document subsequently fed thereto.

By the arrangement according to the present invention as described above, an improved copying apparatus has been advantageously presented.

BRIEF DESCRIPTION OF THE DRAWINGS

These and other objects and features of the present invention will become apparent from the following description taken in conjunction with the preferred embodiments thereof with reference to the accompanying drawings, in which.

DETAILED DESCRIPTION OF THE INVENTION

Figure 1:
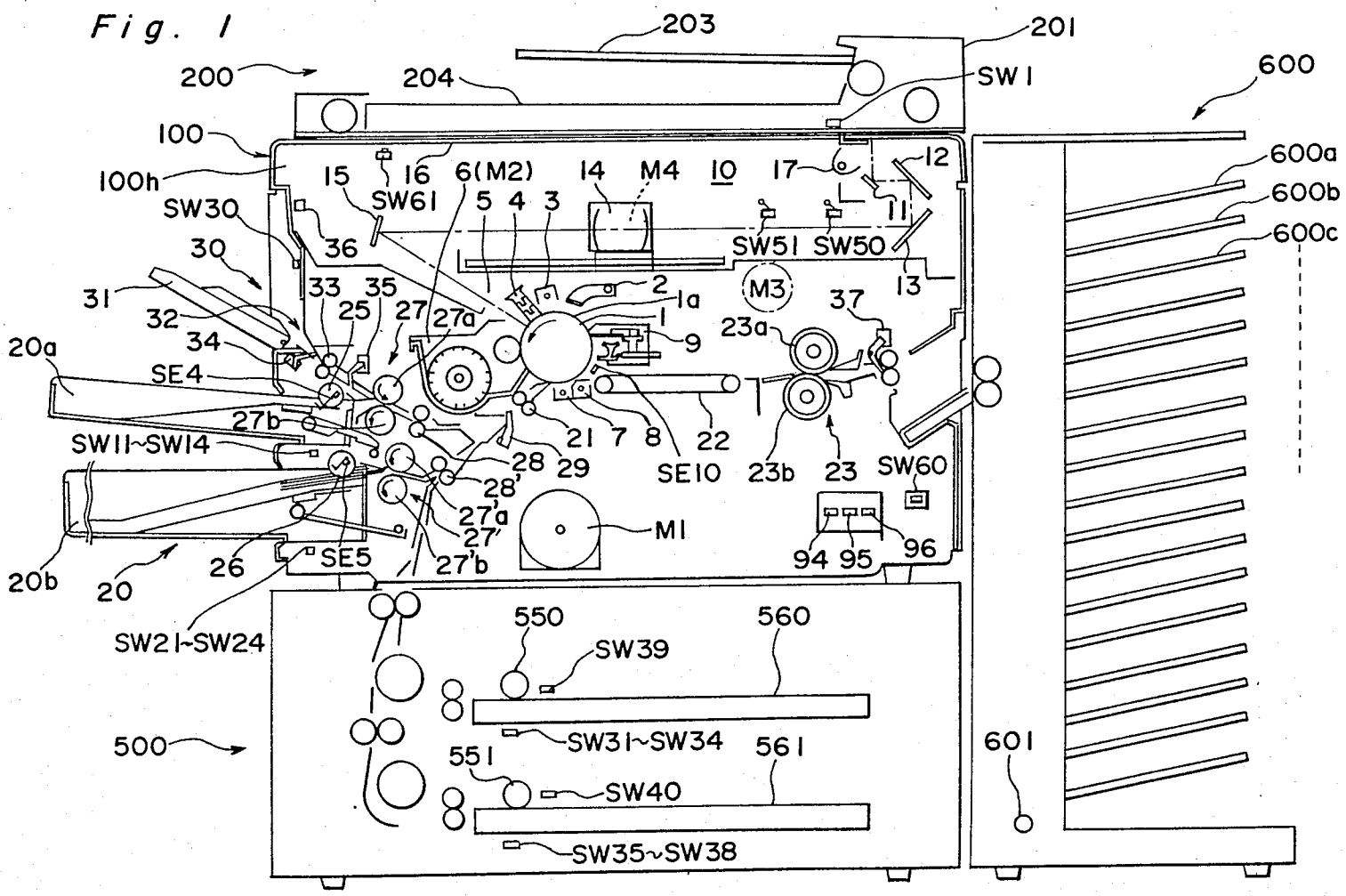
FIG. 1 is a schematic side sectional view of an electrophotographic copying apparatus to which the present invention may be applied.

Before the description of the present invention proceeds, it is to be noted that like parts are designated by like reference numerals throughout the accompanying drawings.

Copying Mechanism

Referring now to the drawings, there is schematically shown in FIG. 1 an electrophotographic copying apparatus 100 to which the present invention may be applied. The electrophotographic copying apparatus 100 generally includes a photosensitive drum or photoreceptor drum 1 rotatably provided at approximately a central portion of an apparatus housing 100*h* for rotation in the counterclockwise direction in FIG. 1, around which various process devices such as an eraser lamp 2, a corona charger 3, an image edge and inter-image eraser 4, a developing device 6, a transfer charger 7, a sheet separating charger 8, and a cleaning device 9, etc. are sequentially disposed. The photoreceptor drum 1 has a photosensitive layer 1*a* formed on its outer peripheral surface, which is uniformly charged as it passes through the eraser lamp 2 and the corona charger 3, and formed with an electrostatic latent image thereon when subjected to an image exposure by a scanning optical system 10 through a slit portion 5. The image edge and inter-image eraser 4 referred to above includes a plurality of light emitting diodes LED (not shown) arranged in a direction of width of the image for removing an unnecessary charge from the photosensitive surface 1*a* of the photoreceptor drum 1, and its construction and control thereby will be described later.

The scanning optical system 10 provided below a transparent original document platform 16 for scanning of the image of the original document (not particularly shown) placed on the platform 16 includes a light source 17, movable mirrors 11, 12 and 13, a lens assembly 14 and another mirror 15 as illustrated. With respect to a photoreceptor drum 1 having a circumferential speed V (which is constant irrespective of an equal size magnification, i.e., magnification at 1:1, and varied magnifications), the light source 17 and the movable mirror 11 move in one unit towards the left at a speed of v/m (wherein m is the copying magnification), while the movable mirrors 12 and 13 are driven to be displaced in one unit towards the left at a speed of v/2m. For alteration of the copying magnifications, there are involved such functions that the lens assembly 14 is displaced on an optical axis, while the mirror 15 is moved with a rocking motion to correct the optical path, but since a magnification altering mechanism as described above has been already known, it is only described that the lens assembly 14 and the mirror 15 are subjected to an associated movement by a step motor M4 for positional control according to magnification data to be described later, with detailed explanation of the specific associating mechanism, etc. being omitted in the description to be given hereinafter.

Copy paper sheets are fed, one sheet by one sheet, into the apparatus 100 by an automatic paper feeding mechanism 20 having upper and lower two-stage cassette mounting sections 20*a* and 20*b* provided at the left side of the apparatus housing 100*h* or by a manual paper feeding mechanism 30 provided above the automatic paper feeding mechanism 20, and after once being stopped by timing rollers 21, fed into the transfer section in synchronization with the image formed on the photosensitive surface 1*a* of the photoreceptor drum 1 so as to be transferred with a toner image by the transfer charger 7, and subsequently, separated from the photosensitive surface 1*a* by the separating charger 8 to be fed into a fixing device 23 including rollers 23*a* and 23*b* via sensor SE10 and a transport belt 22 for fixing of the image thereon, and finally, discharged out of the copying apparatus 100 through a pair of discharge rollers provided with a sensor 37.

After the transfer, toner and charge remaining on the photosensitive surface 1*a* of the photoreceptor drum 1 are removed by the cleaning device 9 and the eraser 2, etc. to prepare for a subsequent copying process.

Either the automatic paper feeding mechanism 20 or the manual paper feeding mechanism 30 is selectively used for copying depending on necessity. For the change-over, it is so controlled that, by detecting with a sensor 36, opening or closing, i.e., raising or lowering through a pivotal movement of a manual insertion table 31 which is arranged to cover a manual insertion port 32 upon closing, and to expose said portion 32 upon opening for simultaneously serving as a guide for the copy paper sheet to be manually inserted, the copying mode by the manual paper feeding is achieved when a paper insertion sensor 34 has detected the insertion of the copy paper sheet in the "open" state of the manual insertion table 31, while the copying mode by the automatic paper feeding is established upon "closing" of the manual insertion table 31 or through a signal by the automatic paper feeding selecting operation or by the operation of ten-keys for setting the number of sheets to be copied (described in more detail later).

In the case of the automatic paper feeding, the image forming system including the photoreceptor drum 1 is started by the operation of a print key PSW (FIG. 7) for starting the copying operation of the copying apparatus 100, and upon completion of the processing for preparatory driving with respect to the photoreceptor drum 1, a paper feeding roller 25 for the upper cassette mounting section 20*a* with a sensor SE4 of a paper feeding roller 26 for the lower cassette mounting section 20*b* with a sensor SE5 is driven, and thus, by a scan starting signal produced following transport of the copy paper sheet, the scanning optical system 10 is started to be driven so that the copy paper sheets are transported in synchronization with the image forming functions. The copy paper sheets are pushed forward in two or three sheets through rotation of the paper feeding roller 25 or 26, and only the top sheet is further transported by a loosening mechanism 27 or 27' at a subsequent stage.

In the loosening mechanisms 27 and 27', upper rollers 27*a* and 27'*a* are driven for rotation in the paper feeding direction, while lower rollers 27*b* and 27'*b* are driven for rotation in a direction for pushing back the copy paper sheets as indicated by arrows, and the copy paper sheets after the second sheet which are pushed forward by the paper feeding rollers 25 or 26 together with the top sheet, are pushed back by the lower, roller 27*b* or 27'*b*, and only the top sheet is further fed toward a pair of intermediate rollers 28 or 28' at a subsequent stage. As described in more detail later, the intermediate rollers 28 and 28' are controlled in the driving thereof in association with a pair of timing rollers 21 provided at a subsequent stage.

On the contrary, in the case of the manual insertion paper feeding, when the copy paper sheet inserted through the manual insertion port 32 is detected by the sensor 34, a pair of manual insertion paper feeding rollers 33 are rotated for feeding the copy paper sheets into the apparatus housing 100*h*, and simultaneously with the above or at a slight delay therefrom, the photoreceptor drum 1 is started to rotate in the similar manner as in the operation of the print key described earlier. Thus, the copy paper sheet manually inserted is once stopped for standing-by at a sheet leading edge detection switch 35, and, upon completion of the processing for the preparatory driving including rotation of the photoreceptor drum 1, the rollers 33 are again rotated, whereby said copy paper sheet is fed into the apparatus 100.

It should be noted here that, as described in more detail later, in the above copying apparatus 100, the manual insertion table 31 is arranged to be detachable with respect to the apparatus housing 100*h*, so that a paper feeding unit for general purpose incorporated with a paper feeding motor and paper feeding rollers, etc. may be mounted instead of the manual insertion table 31, thereby to provide the function equivalent to an apparatus equipped with an automatic paper feeding section in three stages.

Moreover, at the respective upper and lower cassette mounting sections 20*a* and 20*b* of the automatic paper feeding mechanism 20, there are respectively provided size detection switches SW11, SW12, SW13 and SW14, and SW21, SW22, SW23 and SW24 so as to detect sizes of loaded copy paper sheets in a binary code of four bits through variations of the state of functioning of these switches by the arrangement of projections or magnets (not shown) provided in the cassettes to be mounted. For judging the sizes of copy paper sheets through employment of the cassettes in which the copy paper sheets are accommodated, various mechanisms have already been known, and therefore, detailed description thereof is abbreviated here for brevity.

On the copying apparatus 100, an automatic original document feeding device or ADF unit 200 can further be mounted, thereby to carry out the copying function in association with each other.

Upon detection that the ADF unit 200 has been electrically connected with the copying apparatus 100 and disposed at a predetermined position on the original document platform 16, by a switch SW1 provided at the upper portion of the copying apparatus 100, the controls for the ADF unit 200 and the copying apparatus 100 are associated with each other, and when the ADF mode key provided on a control panel, to be described later, is depressed, the functioning mode of the copying apparatus 100 is changed over to the ADF mode. The ADF mode referred to above is such that, upon actuation of the print key PSW provided on the control panel, to be described later, the ADF unit 200 starts functioning, with the copying apparatus 100 being maintained in the stand-by state as it is, and feeds the original document placed on an original document tray 203, along the upper surface of the transparent original document placing platform 16 of the copying apparatus 100 so as to stop said original document at a predetermined position, while simultaneously, a start signal is applied from the ADF unit 200 to the copying apparatus 100 to start the copying functions as described earlier. Upon completion of a final scanning movement with respect to said original document, a functioning signal is applied from the copying apparatus 100 to the ADF unit 200, which then discharges the original document onto a discharge tray 204. In this case, if a next original document is present on the original document tray 203, transportation of the next original document to the predetermined position is also effected simultaneously with the discharge of the former original document as described above.

Figure 2:
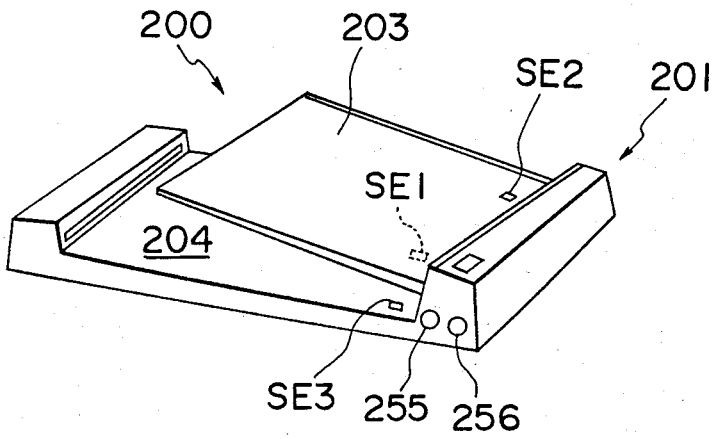
FIG. 2 is a perspective view showing an automatic original document feeding device or ADF unit which may be employed for the copying apparatus of the present invention.

The ADF unit 200 further includes a driving second 201 and sensors as shown in FIG. 2. In a perspective view of the ADF unit 200 shown in FIG. 2, there are provided an original document length sensor SE1 so positioned as to be capable of detecting the original document irrespective of the size and orientation thereof, and an original document width sensor SE2 which assumes two states for detection and non-detection according to widths of original documents, and is positioned in the vicinity of an original document insertion port, and by signals from these two sensors SE1 and SE2, the sizes and orientation of original documents are detected.

Although various systems have been conventionally proposed for the identification of copy paper sheets employed, according to the present embodiment, there is adopted the system in which the original document in the state of transportation is detected by the original document length sensor SE1 for a measurement of the detecting time, while judgement is made as to whether or not the original document width sensor SE2 is detecting the original document for finding the size and orientation of the original document based on both signals. In the above system, if the original documents are of regular paper sizes, almost all the sizes can be identified only by the length signals, but in the paper sizes for the A row and B row employed in Japan, there are cases where sizes are different according to lengths and widths of the paper sheets, even when the length signals are equal to each other, and therefore, the original document width sensor SE2 is provided for the discrimination thereof.

The ADF unit 200 of FIG. 2 further includes a sensor SE3 for detecting a mode card having copying mode data, to be described later, and its mode code, an original document discharge roller 255, and an original document feeding motor 256 as shown.

Figure 3:
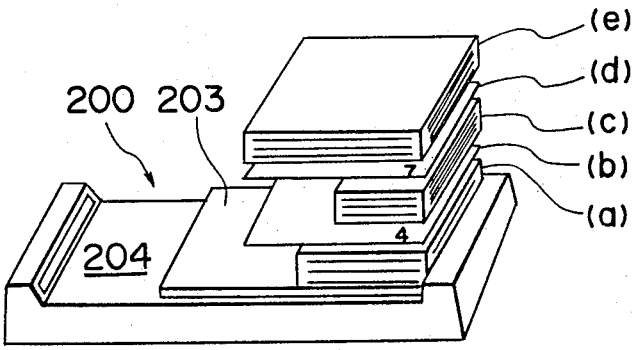
FIG. 3 is a perspective view similar to FIG. 2, which is particularly explanatory of procedures for placing original documents and mode cards on an original document tray of the ADF unit.

Referring particularly to FIG. 3, procedures for placing original documents and mode cards to set copying modes on the original document tray 203 of the ADF unit 200 will be described hereinbelow.

Figure 4A:
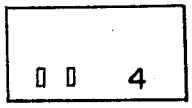
FIGS. 4(*a*) and 4(*b*) are diagrams showing examples of the mode cards.
Figure 4B:
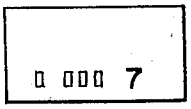

In the first place, an original document (a) for effecting copying by a first copying mode is placed on the original document tray 203, and a mode card b is placed on said original document a. This mode card b is formed with punched holes representing the mode code 4 shown, for example, in FIG. 4(*a*). On the above mode card b, an original document c for effecting copying by the copying mode of the mode code 4 is placed. Furthermore, on the original document c, a mode card d (FIG. 4(*b*)) formed with punched holes indicating the mode code 7 is placed, while another original document e for effecting copying by the copying mode of this mode code 7 is placed on the mode card d.

Referring back to FIG. 1, there is provided under the apparatus housing 100*h*, a paper feeding unit 500 which is commonly used as a base for placing said apparatus housing 100*h* thereon, and in which an upper paper feeding cassette 560 and a lower paper feeding cassette 561 are provided. There are also provided cassette code sensors SW31, SW32, SW33 and SW34 for detecting cassette codes corresponding to sizes of the upper paper feeding cassette 560, cassette code sensors SW35, SW36, SW37 and SW38 for detecting cassette codes corresponding to sizes of the lower paper feeding cassette 561, an upper paper feeding empty sensor SW39 for detecting "paper empty" for the upper paper feeding cassette 560, and a lower paper feeding empty sensor SW40 for detecting "paper empty" for the lower paper feeding cassette 561. Further provided are an upper paper feeding clutch 550 for feeding copy paper sheets from the upper paper feeding cassette 560 to the copying apparatus 100, and a lower paper feeding clutch 551 for feeding copy paper sheets from the lower paper feeding cassette 561 to the copying apparatus 100.

Figure 5:
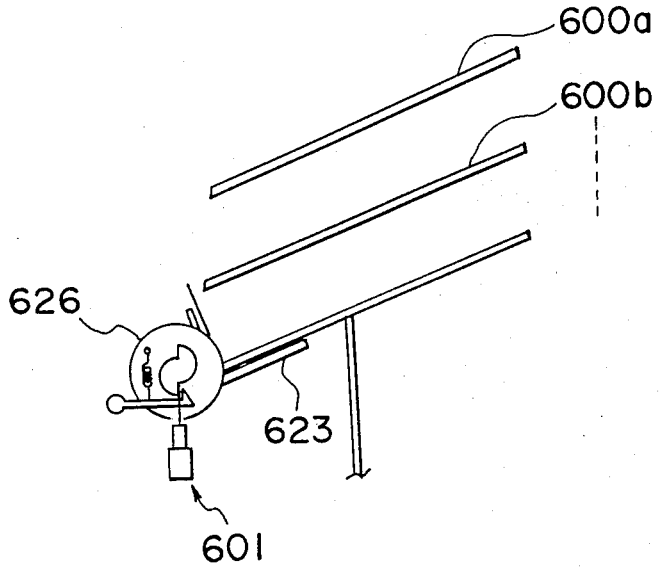
FIG. 5 is a fragmentary side elevational view showing on an enlarged scale, a shift clutch and its surrounding portions.
Figure 6:
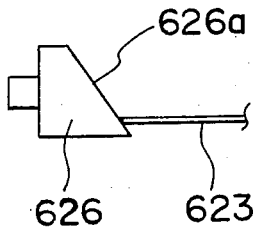
FIGS. 6(*a*) and 6(*b*) are diagrams explanatory of functions of a half-rotation clutch.
Figure 6:
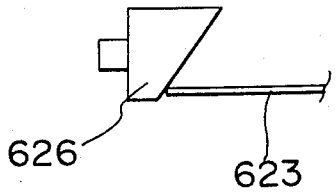

A sorter 600, provided at the right side with respect to the copying apparatus 100 in FIG. 1, is arranged to discharge copy paper sheets completed for copying and fed from the apparatus housing 100*a* into predetermined bins 600*a*, 600*b*, 600*c* and so forth according to the order of copying, and also to classify the copy paper sheets through alteration of discharging positions thereof by deviating positions of said bins 600*a*, 600*b*, 600*c* and so forth. As shown in FIGS. 5 through 6(*b*), there is provided a mechanism for the above purpose in which, at a shift clutch 601, a half rotation clutch 626 having an inclined faces 626*a* effects a half rotation each time the copying mode is altered, and a frame bar 623 contacting said inclined face 626*a* at its one end is reciprocated, thus subjecting the bins 600*a*, 600*b*, 600*c* and so forth connected at the other end of the frame bar 623 to reciprocating movements.

In the copying mechanism as described so far, the copying apparatus 100 is further provided with operating and control mechanisms as explained hereinbelow for effecting controls corresponding to states of various sensors and input switches.

Operating and Control Mechanisms

Figure 7:
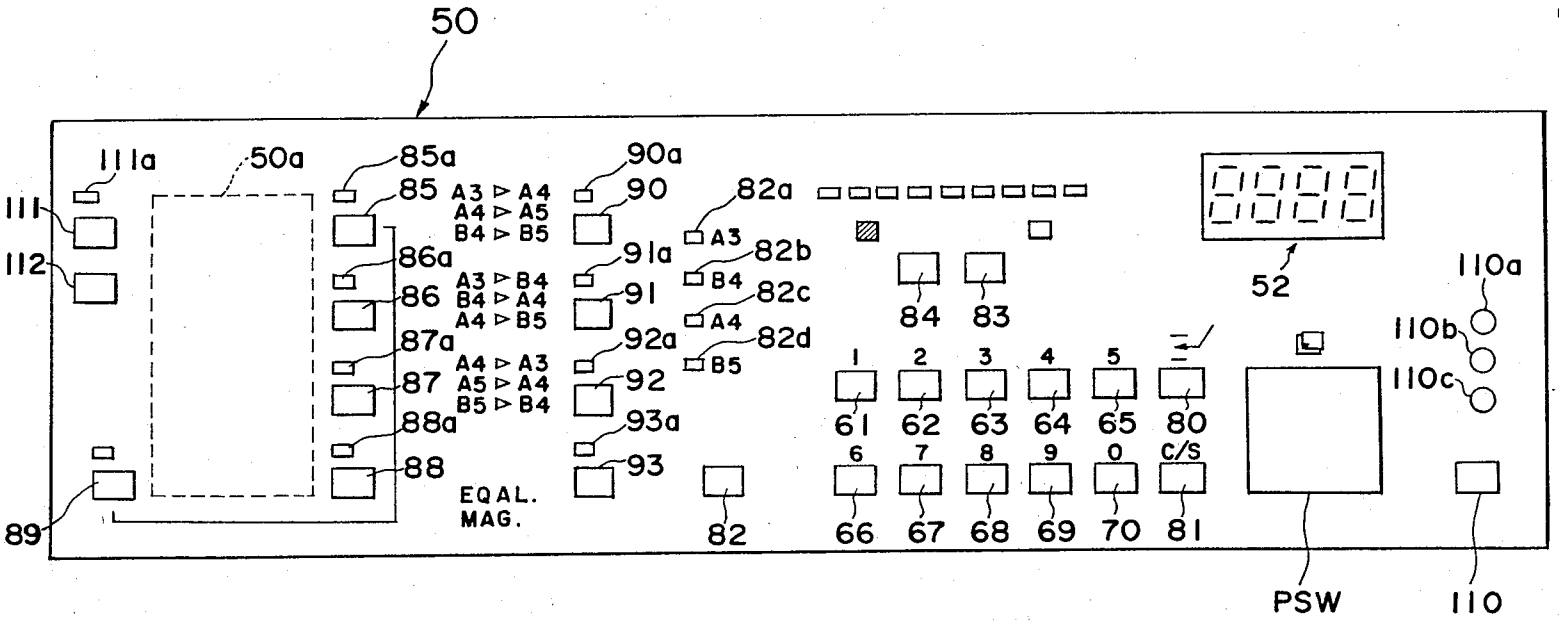
FIG. 7 is a front elevational view showing an arrangement of a control panel for the copying apparatus of FIG. 1.

Referring to FIG. 7, there is shown a positional relation of various operating keys on a control panel 50 of the copying apparatus 100.

On the control panel 50, there are disposed the print key switch PSW for starting the copying functions, a numerical value display device 52 capable of displaying numerical values in four digits, ten-keys 61, 62, 63, 64, 65, 66, 67, 68, 69 and 70 respectively corresponding to the numerical values 1, 2, 3, 4, 5, 6, 7, 8, 9 and 0, an interruption key 80 for designating the interruption copying, a clear stop key 81, a paper selecting key 82 for designating the copy paper sheets mounted in the multistages according to sizes, up and down keys 83 and 84 for altering and designating the copied image density stepwise, and groups of keys 85, 86, 87, 88, 89, 90, 91, 92 and 93, etc. related to a copying magnification setting device. It is to be noted here that, in terms of circuits, normally open switches correspond to the respective keys, and in the circuit diagrams to be described later, the switches are represented by numerals affixed to the respective keys.

The first group of magnification setting keys 85, 86, 87 and 88 are intended to set the magnifications as desired, and when any of the keys 85 to 88 is operated in the state where the first magnification setting mode changeover key 89 is actuated and the control mode of the copying apparatus 100 has been changed over to the first magnification setting mode, the numerical value input by the ten-keys and indicated on the display unit 52 is stored in a memory corresponding to the key operated at that time as the copying magnification.

In the second group of magnification setting keys 90, 91, 92 and 93, predetermined copying magnifications are preliminarily set in memories corresponding thereto, and it is so arranged that the copying functions may be effected based on the preset values, without necessity for setting the numerical value as in the first group of keys described above. Accordingly, for the magnifications to be preset, for example, magnifications which are expected to be frequently used normally are selected according to destinations at a stage of shipping from a factory. With respect to the above, more detailed description will be given later.

As described so far, the first group of keys are intended to allow an operator to set necessary copying magnifications as desired, while the second group of keys are provided with a different function so as to preset magnifications corresponding to generally used copy paper sheet sizes, for example, A4→B5, B4→A4, A3→A4 or A4→A3 sizes, etc. for use in Japan. However, since the numerical values to be preset with respect to the second group of keys relate to copying magnifications in general or those based on calculations, there are cases where copied items actually obtained have copying magnifications slightly different from the above present copying magnifications. For example, even when the equal size or life size magnification (×1) has been selected, there may be a case where the magnification is actually (×1.004) or (×0.996). In such as case as above, it is possible to obtain a desired copying magnification by changing-over the control mode of the copying apparatus to the second magnification setting mode through operation of the second magnification setting mode change-over key 94 shown in FIG. 1, and setting the numerical values as desired in the memories corresponding to the respective keys 90 to 93 through operation similar to that for the first magnification setting mode.

Still referring to FIG. 7, at the lower right portion of the control panel 50, there are provided an ADF mode key 110 for selecting the ADF mode which effects the automatic feeding of original documents by the ADF unit 200, and indicating lamps 110*a*, 110*b* and 110*c* for respectively indicating an automatic paper select mode, an automatic magnification select mode, and a manual mode in said ADF mode.

The automatic paper select mode referred to above is the mode in which, with the copying magnification fixed, the paper feeding section is automatically selected by determining the optimum copy paper size based on the size of an original document to be inserted and its magnification for feeding copy paper sheets from said paper feeding section thus selected.

Meanwhile, the automatic magnification select mode is so arranged that, with the size of copy paper sheets to be employed being fixed, the corresponding copying magnification is calculated based on the size of an original document to be inserted and the size of the copy paper sheet therefor, and the copying magnification is automatically set by the magnification setting mechanism to be described later for effecting the copying functions.

At the upper left portion of the control panel 50 in FIG. 7, a copying mode setting key 111 is provided for setting the copying mode data including the number of copied sheets to be taken, exposure position, ADF mode, paper size and copying magnification. Above the copying mode setting key 111, a copying mode set indicating lamp 111*a* is provided for indicating that the above copying mode data are being set. There is also provided a copying mode store key 112 for storing the set copying mode data in the memory.

Switches corresponding to the respective input keys as described above and various sensors provided in the copying apparatus 100 and the ADF unit 200 are associated with a control mechanism 300 including a microcomputer system as shown in FIGS. 8 through 14.

Figure 8:
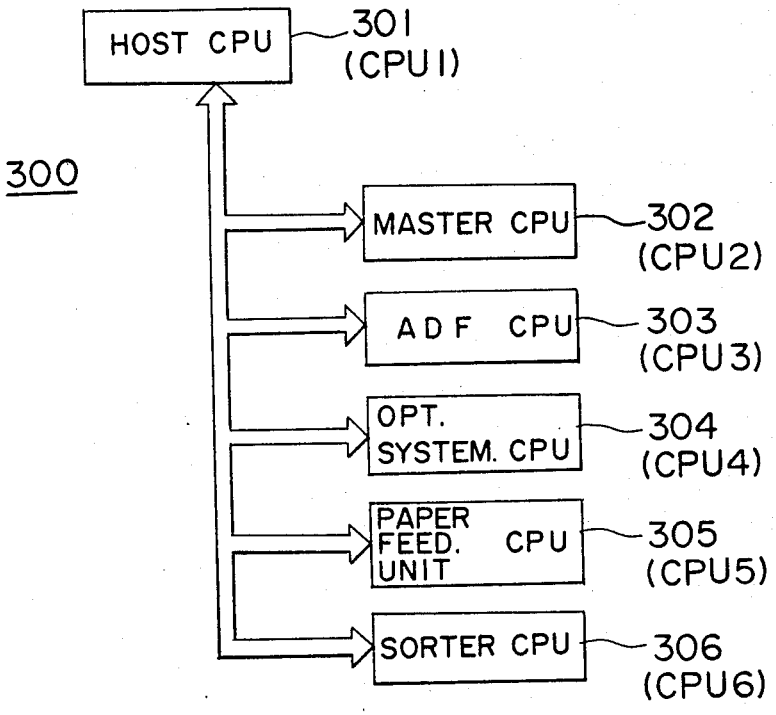
FIG. 8 is a block diagram showing a micro-computer system employed in the copying apparatus of FIG. 1.

In FIG. 8, there is shown the relation among microprocessors (referred to merely as CPU hereinafter) 301, 302, 303, 304, 305 and 306 in the control mechanism 300. The CPU 301 is a host CPU playing the most important part for the control, and as in the input/output relation thereof shown in FIGS. 9 to 14, the serial-out terminal Sout of the host CPU 301 is connected to serial-in terminals Sin of the respective slave CPU 302 to 306, the serial-in terminal Sin of the host CPU 301 is connected to serial-out terminals Sout of the slave CPU 302 to 306, the interruption request terminal INTreg of the host CPU 301 is coupled to interruption terminals INT of the respective slave CPU 302 to 306, the clock output terminal CLKout of the host CPU 301 is connected to clock input terminals CLKin of the respective slave CPU. The terminal INTreg of the host CPU 301 becomes "High" at a predetermined period, and from the serial-out terminal Sout of the host CPU 301, data block including transfer data for the respective slave CPU 302 to 306 are successively fed into bus lines by clock signals in synchronization with the above period, while the respective, slave CPU 302 through 306 take in the data from the serial-in terminal Sin thereof at the timing of "High" assigned thereto or produce data from the serial output terminals thereof by the clock signals. When the terminal INTreg of the host CPU 301 is "Low", the respective slave CPU 302 through 306 take in the read data for calculation, and write fresh data in registers and the like depending on necessity to wait for the terminal INTreg of the host CPU to assume "High".

Figure 9:
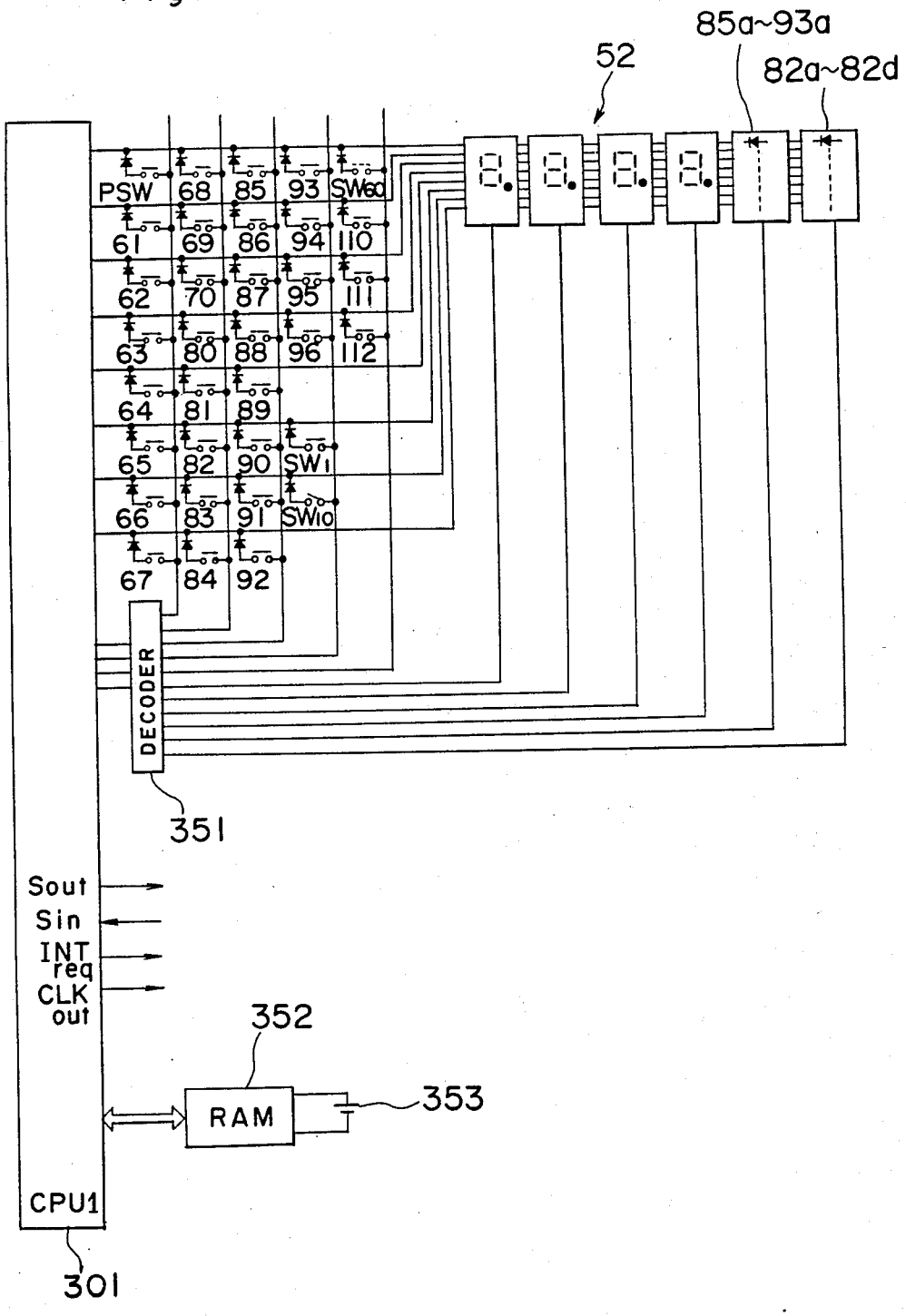
FIGS. 9 through 14 are block diagrams showing detailed constructions of the respective blocks in FIG. 8.

FIG. 9 shows the relation between the host CPU 301 and the copying mechanism, etc. by electrical inputs and outputs therebetween.

The host CPU 301 is provided in the apparatus housing 100*h* of the copying apparatus 100, and mainly connected, through a decoder 351, with the groups of keys and display unit 52, etc. provided on the control panel 50 so as to effect judgement of key inputs and controls of display outputs for numerical values, light emitting diodes and the like. There is provided a random access memory (RAM) 352 which is backed up by a battery or cell 353, and stores therein variable data to be retained even after turning off of a power supply, such as set magnification data, and data representing copying function executing mode including a combination of various set conditions in the copying.

Figure 10:
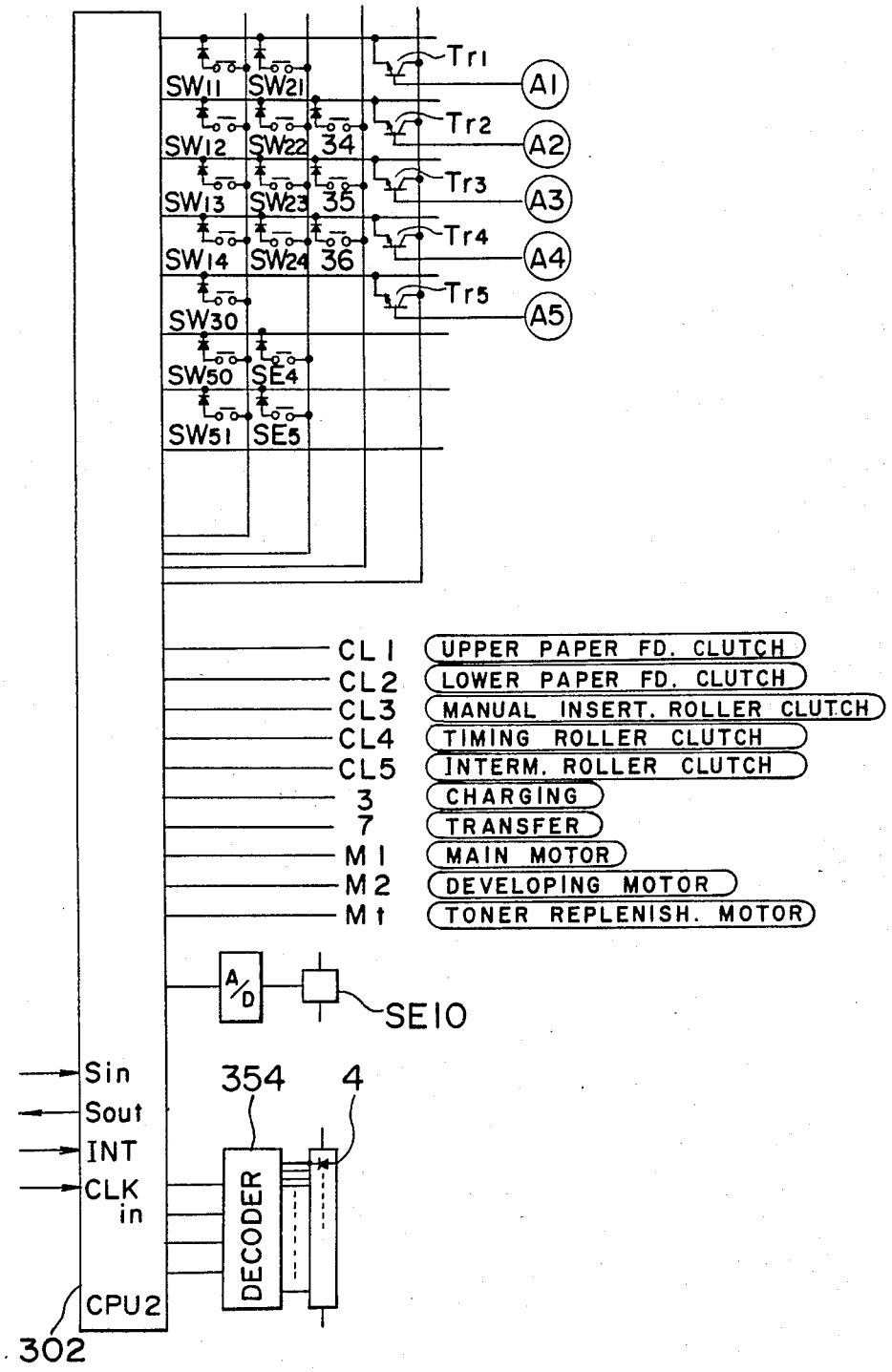

FIG. 10 shows the relation between the master CPU 302 and inputs and outputs thereof. The master CPU 302 mainly executes the function control of the copying apparatus 100 and input judgements for various sensors and switches within the copying apparatus, and also controls energization of respective light emitting diodes for the image edge and inter-image eraser 4 through a decoder 354.

Figure 11:
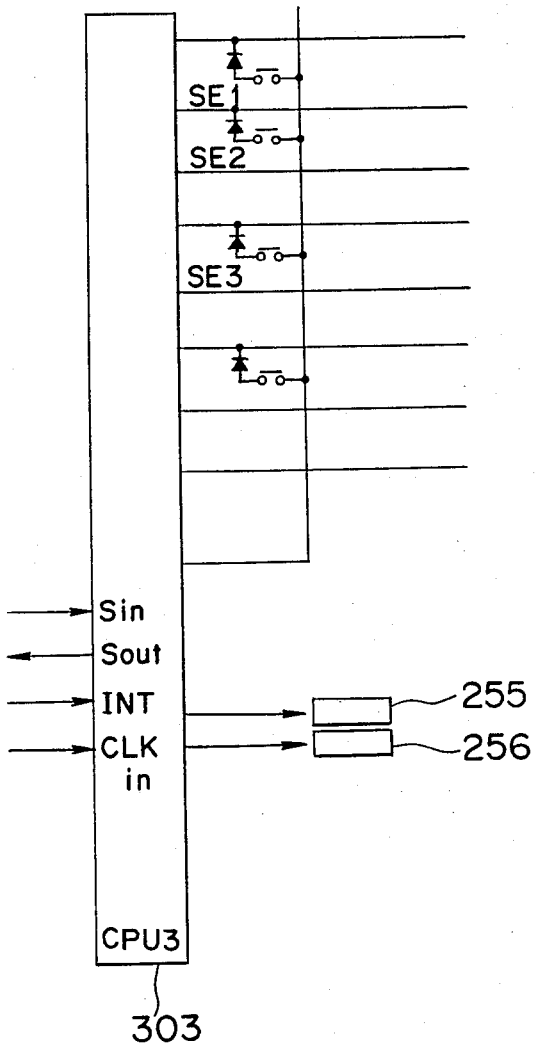

In FIG. 11, the relation between the ADF control CPU 303 and inputs and outputs thereof is shown. The ADF control CPU 303 provided in the ADF unit 200 is connected with the original document sensors SEl, SE2 and SE3, etc. for feeding the input information to the host CPU 301 and also controlling the original document discharge roller 255 and original document feeding roller 256 respectively (FIG. 2).

Figure 12:
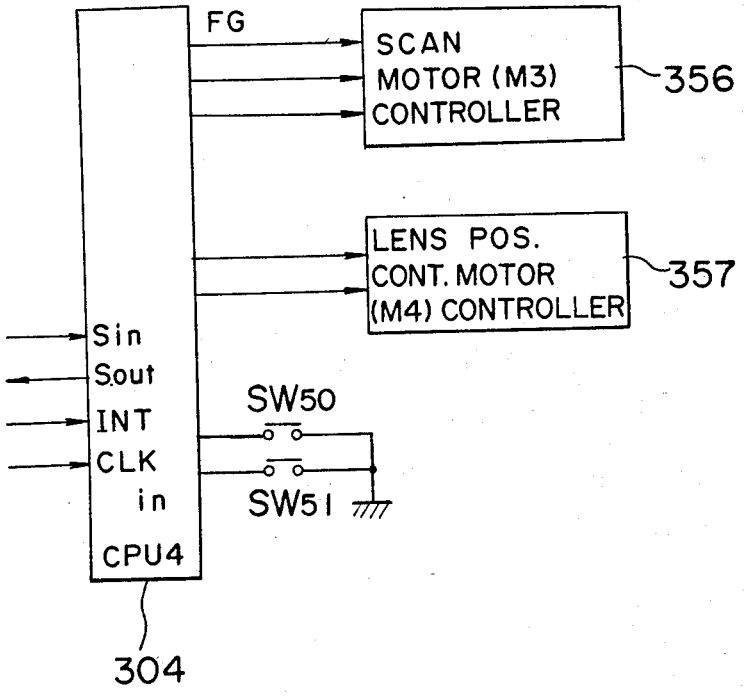

Shown in FIG. 12 is the relation between the CPU 304 related to the control of the scanning optical system 10 and inputs and outputs thereof. The CPU 304 receives the magnification data through the host CPU 301, thereby to apply control signals to a speed control circuit 356 of a scanning driving DC motor M3 and a driving control circuit 357 for the step motor M4 for positional control of the lens assembly 14 and mirrors, and thus, judges the outputs of an exposure start switch SW50 actuated following the movement of the scanning system and the timing switch SW51.

Figure 13:
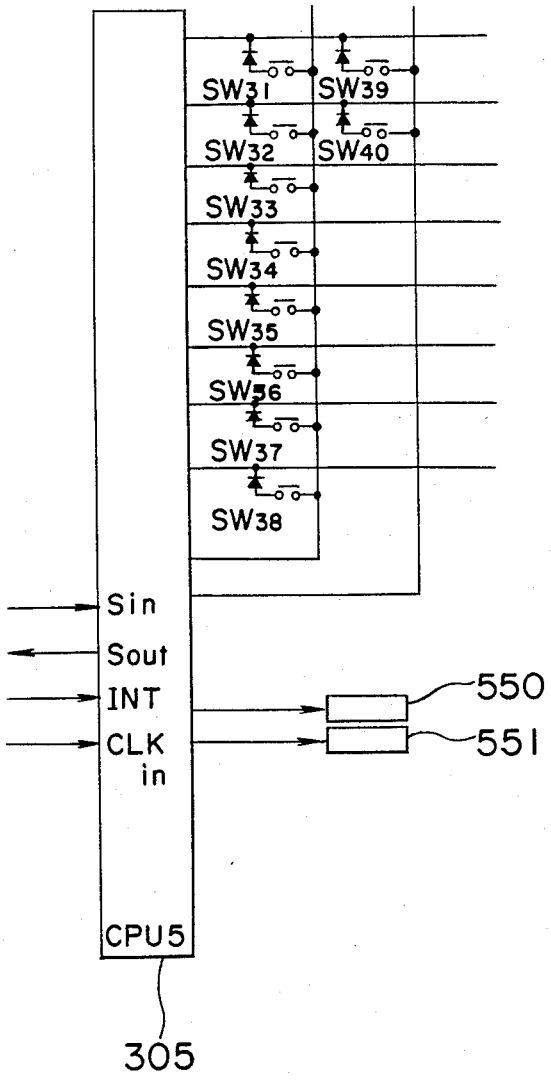

FIG. 13 shows the relation between the CPU 305 provided in the paper feeding unit 500 for the general purpose and inputs and outputs thereof. The CPU 305 receives as inputs, the signals of the copy paper size detecting sensors or switches SW31 to SW34 and SW35 to SW38, and empty sensors SW39 and SW40 provided in the paper feeding unit 500 so as to feed the information thereof to the host CPU 301, thereby to apply driving control signals to the paper feeding clutches 550 and 551.

Figure 14:
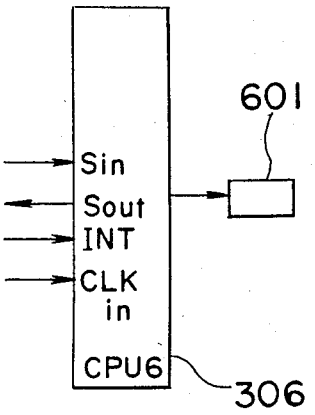

Meanwhile, FIG. 14 shows the relation between the CPU 306 related to the control of the sorter 600 and inputs and outputs thereof. The CPU 306 controls the shift clutch 601 (FIG. 5) according to the data from the host CPU 301.

Detailed Description of the Control

Figure 15:
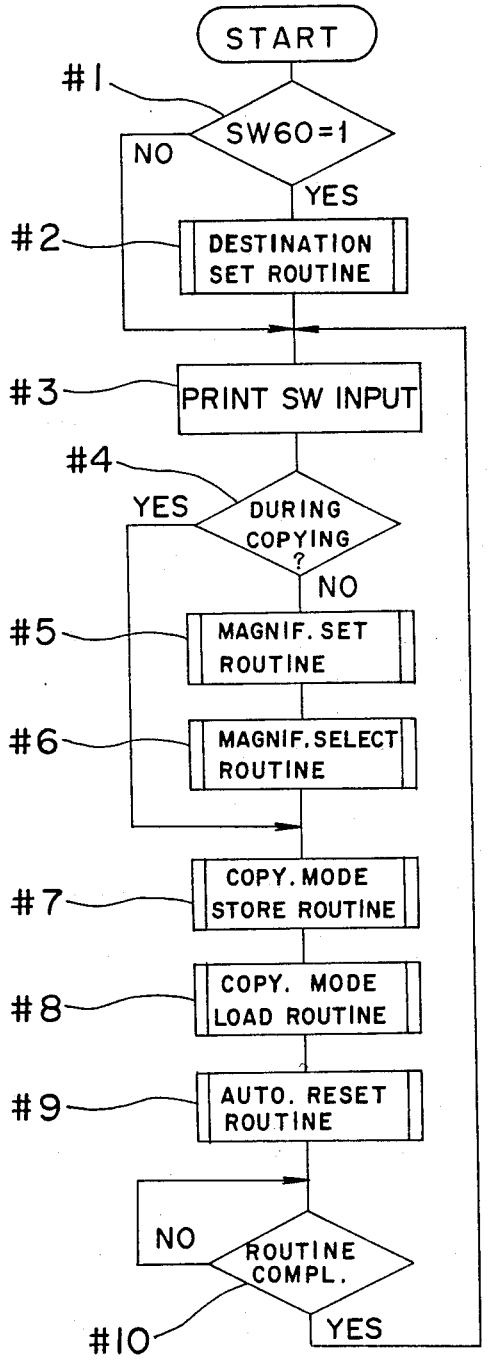
FIGS. 15 through 22 are flow-charts showing control contents and processing procedures for a host CPU (central processing unit)

Referring to FIG. 15, there is shown a flow-chart collectively showing contents of control and process procedures in the host CPU 301, with details of the individual controls being given in flow-charts of FIGS. 16 through 22.

Figure 16:
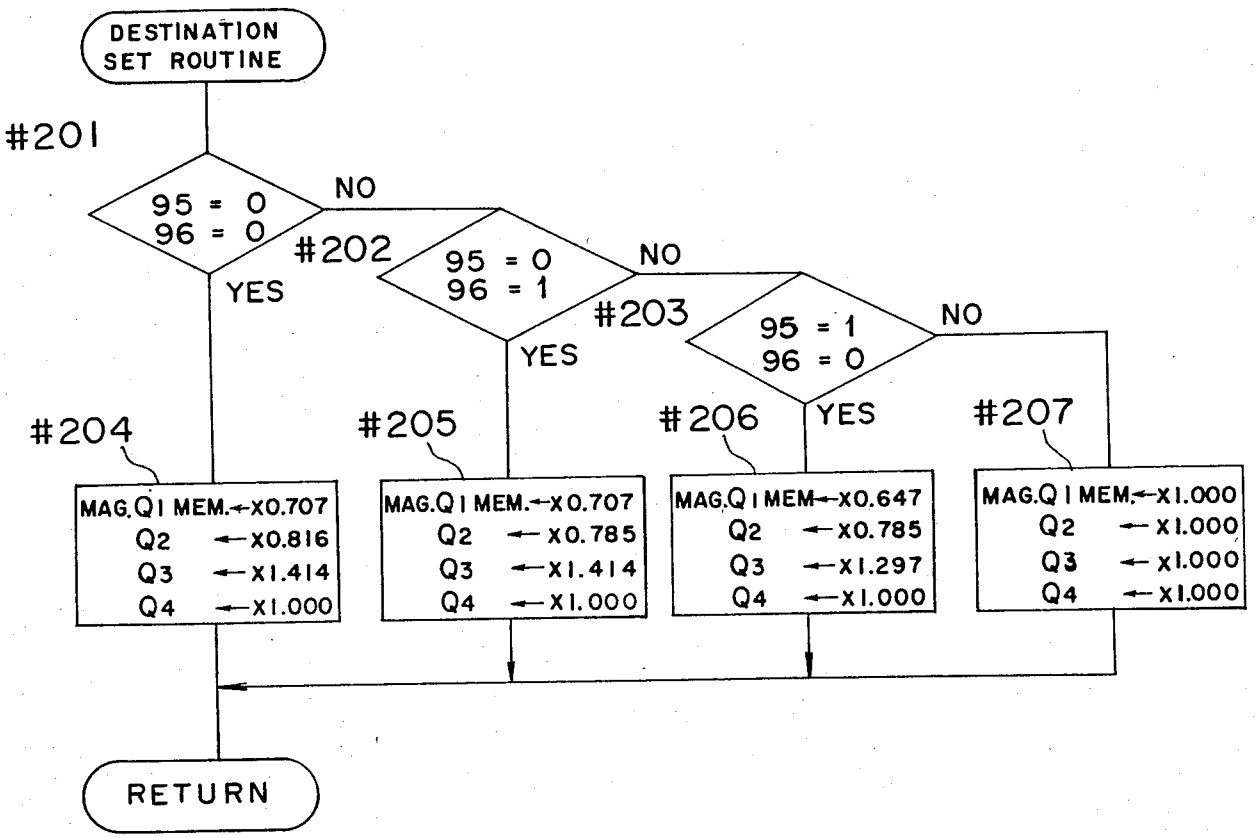

In FIG. 15 (steps #1 through #10), at steps #1 and #2, presetting of magnifications is effected with respect to memories Ql to Q4 provided to correspond to the second group of magnification setting keys 90 to 93, mainly during assembling of the apparatus or at a stage where the apparatus is shipped from a factory. Details of the above process are shown in FIG. 16. An initial switch SW60 at step #1 is a switch provided at a position normally inoperable within the copying apparatus so as to be accessible, for example, only during assembly in a factory or by servicing personnel, and only when this switch is operated, the process as shown in FIG. 16 is executed.

Figure 17A:
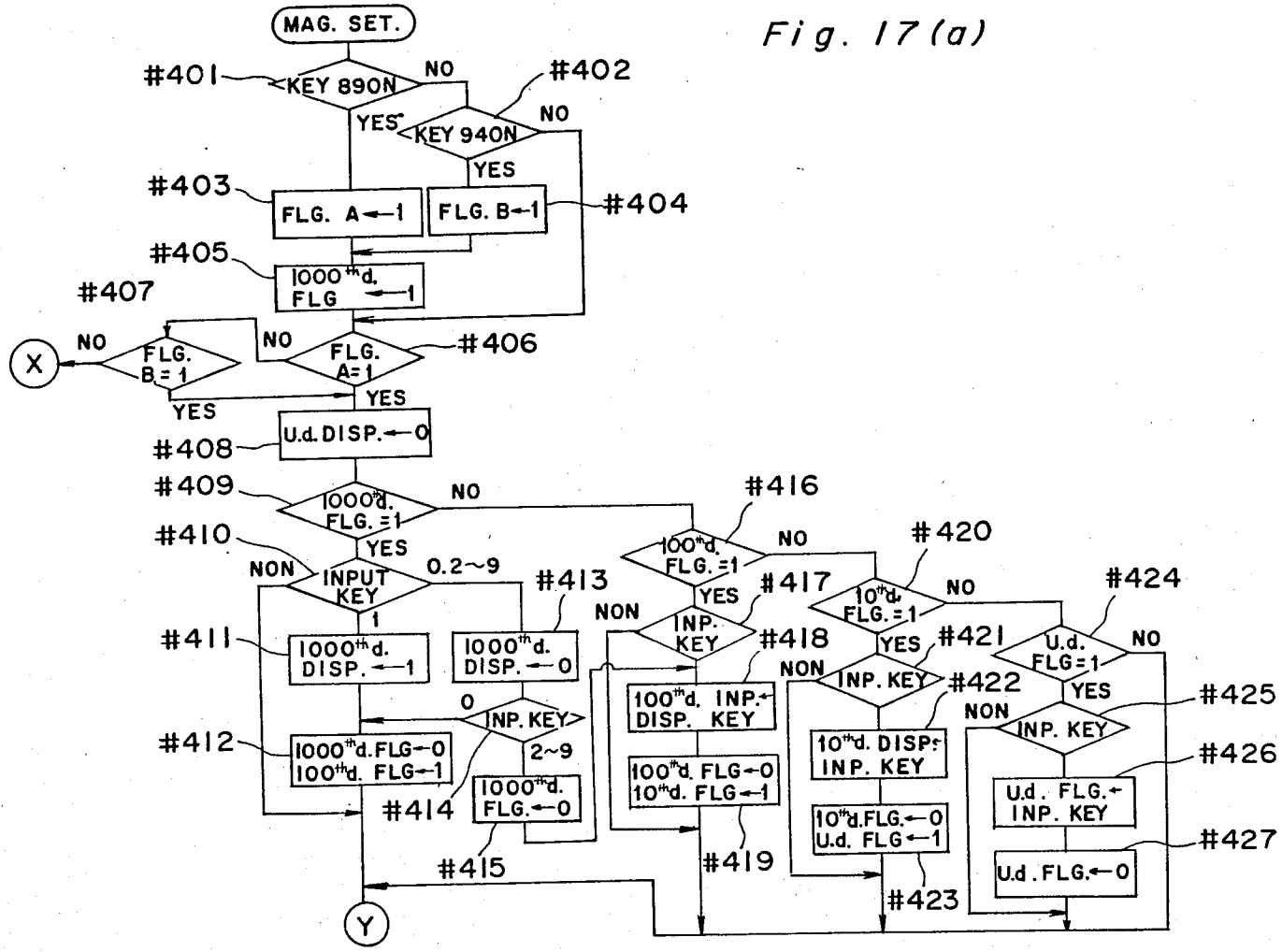
Figure 17B:
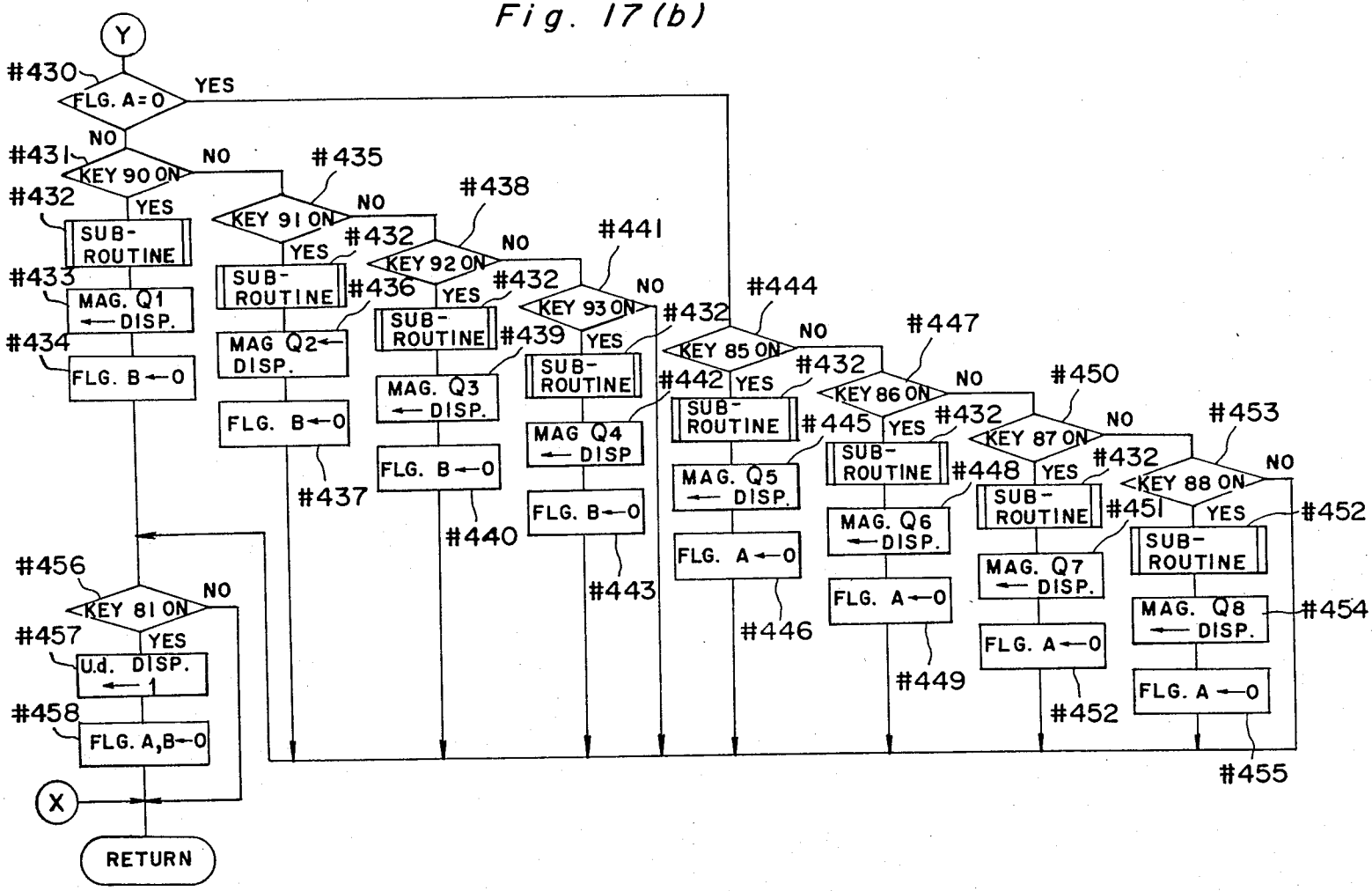
Figure 18:
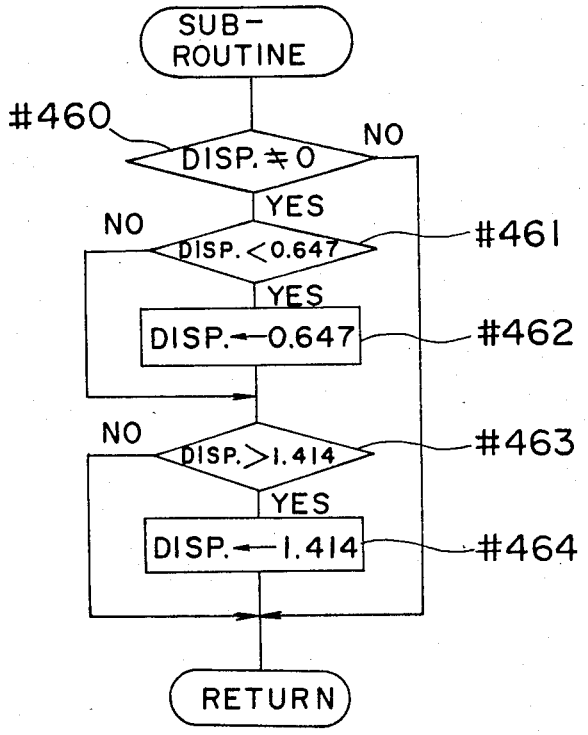

At step #5 in FIG. 15, in the case where the copying apparatus is not functioning for copying, with the print key being input, the process for setting magnifications in the respective selecting keys 85 to 88 or 90 to 93 is executed. Details of this process are shown in FIGS. 17 and 18.

Figure 19:
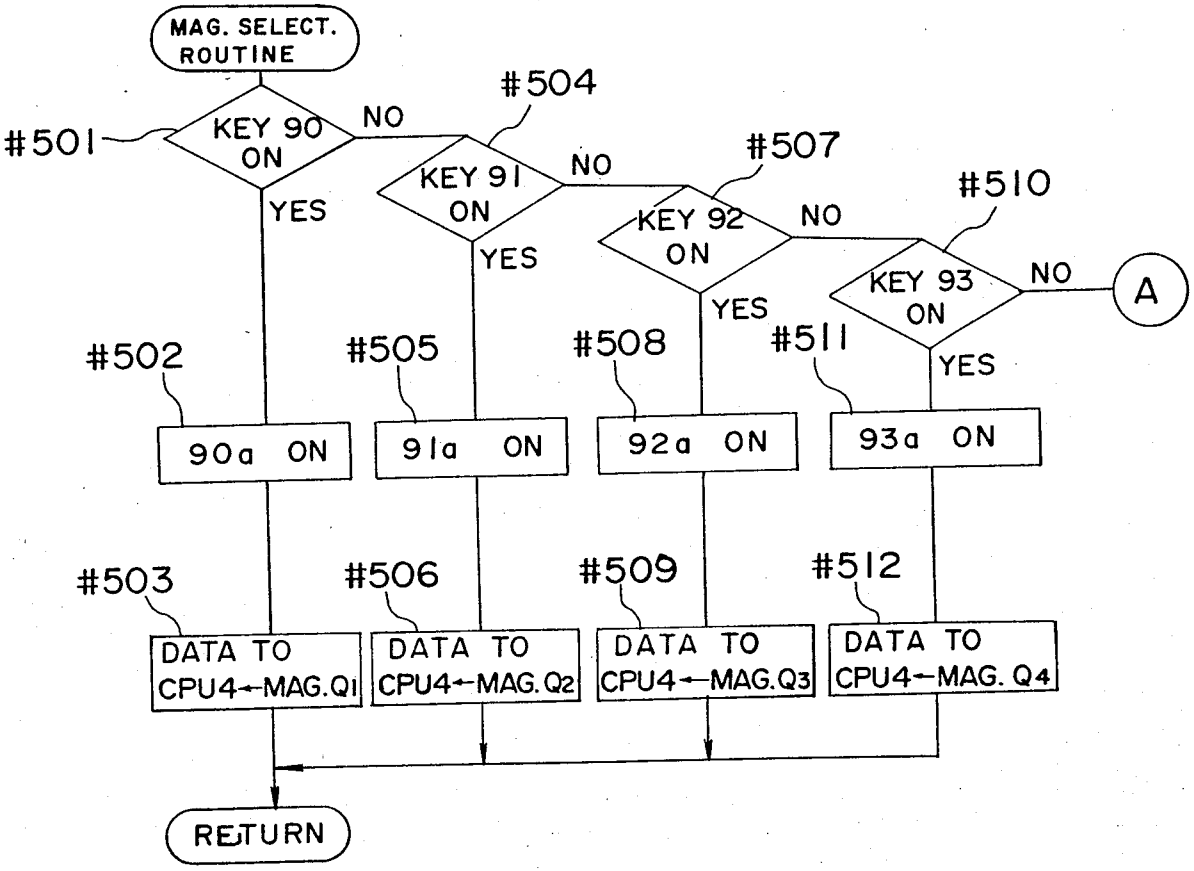
Figure 19B:
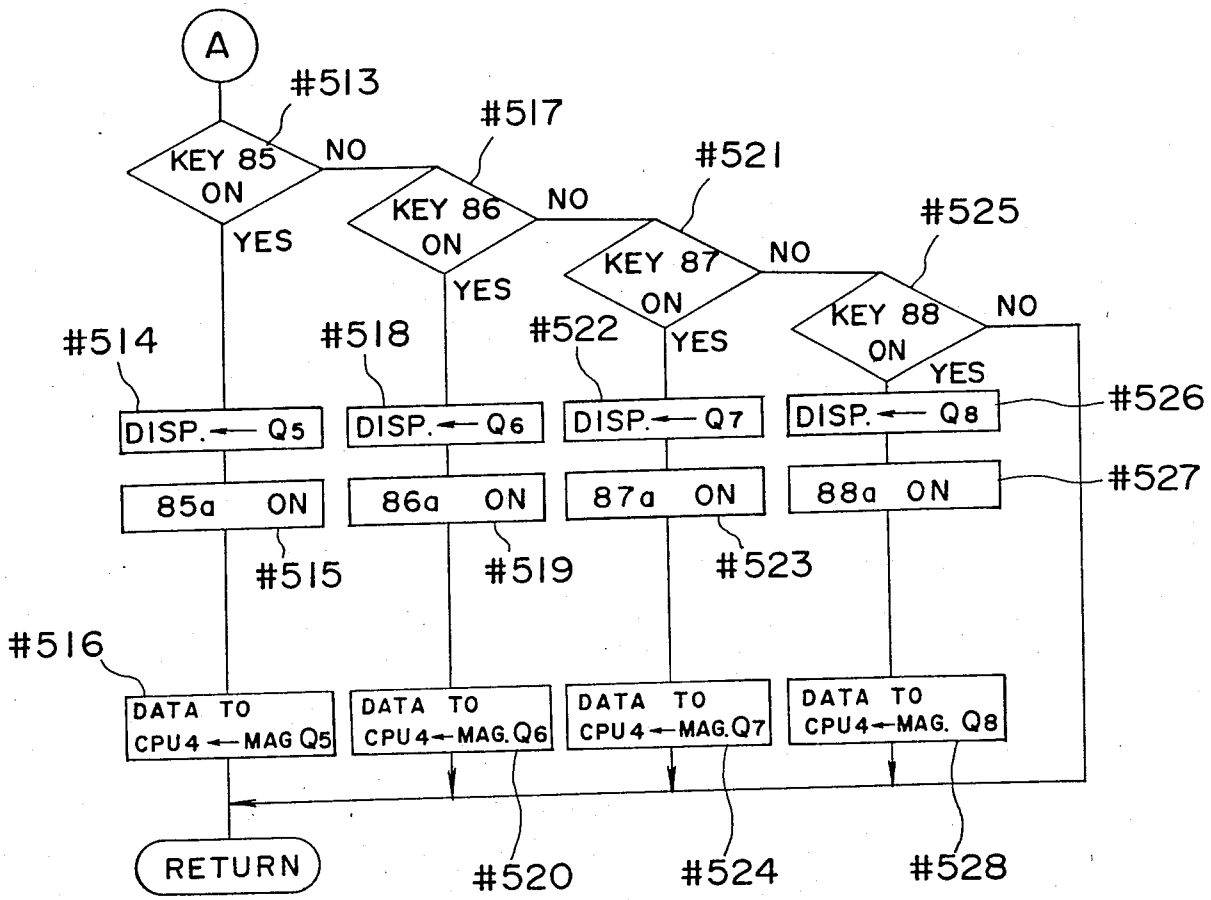

At step #6, a process for transferring data to control the lens assembly position and motor driving speed to the optical system control CPU 304 in correspondence to the magnification set at step #5 is executed. During transfer of said data, the process thereof is effected by an interruption at the CPU 304. Details of step #6 are shown in FIG. 19.

Figure 20A:
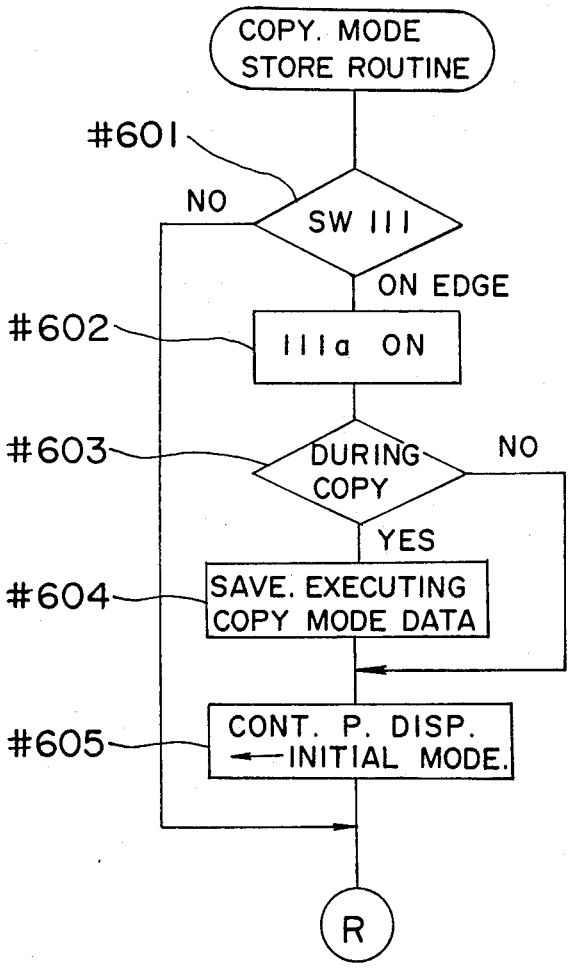
Figure 20B:
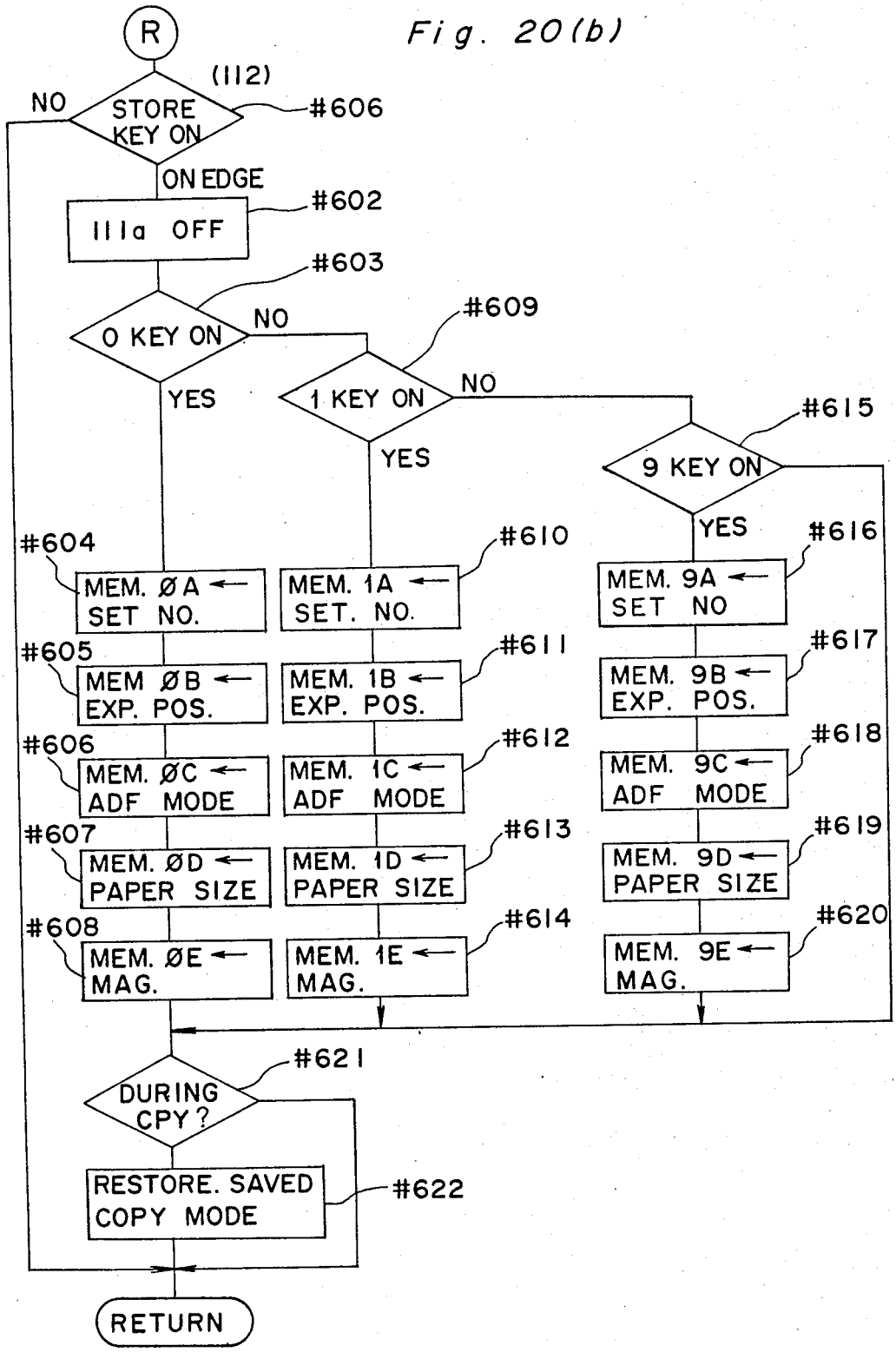

At step #7, copying mode data such as the number of copied sheets to be taken, exposure position, etc. are stored in memories. Details of step #7 are shown in FIG. 20.

Figure 21:
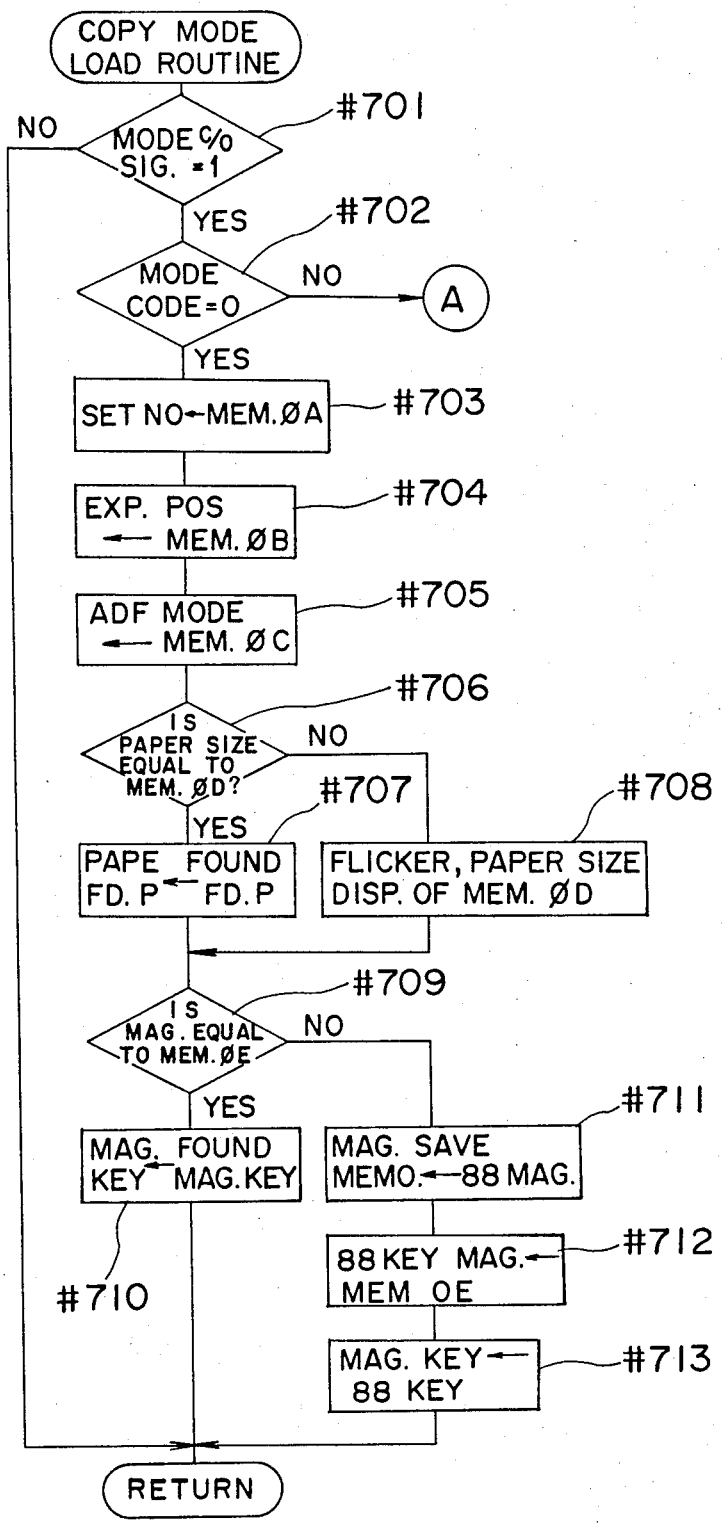

Step #8 shows the process for changing over the copying apparatus into the copying mode preliminarily stored, after completion of the copying in the previous copying mode. Details of step #8 are shown in FIG. 21.

Figure 22:
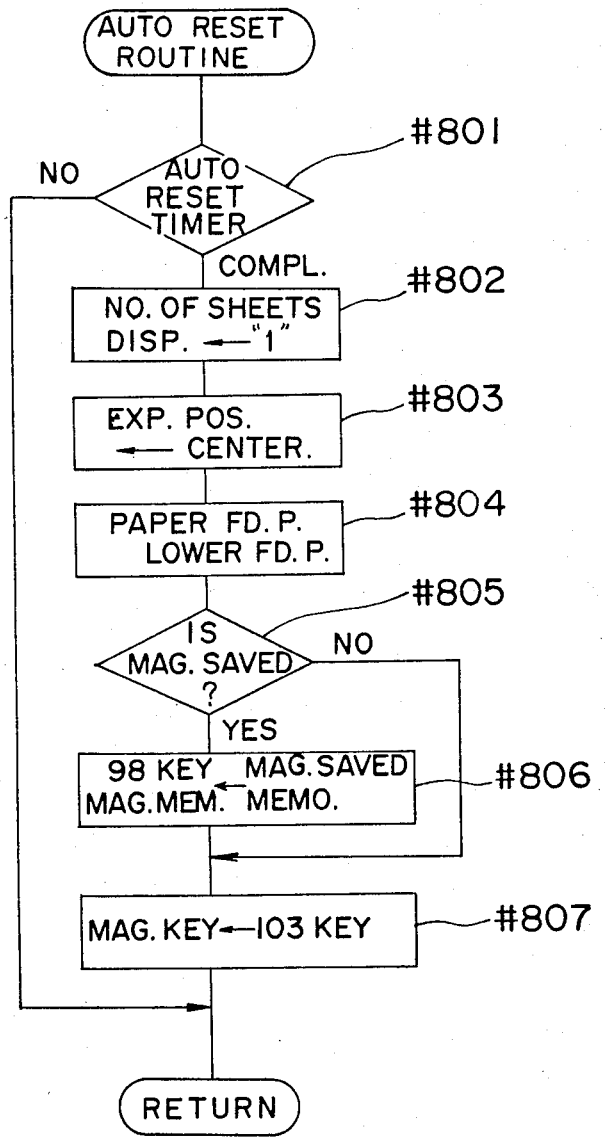

Step #9 shows an auto-reset process for automatically resetting data for variable setting items such as the number of sheets to be copied, copying magnifications, etc., to a standard state, when a predetermined period of time has elapsed without operation of various operating keys or after termination of the copying functions, etc. Details of step #9 are shown in FIG. 22.

Step #10 is a time judging step for rendering the process time for one routine of the control step effected at the host CPU 301, to become constant irrespective of the process contents thereof, and it is so arranged to return to step #3 after waiting for count up of a specific timer for repeating the process as described above.

The flow-chart in FIG. 16 (steps #201 to #207) shows details of the initial stage setting process for presetting predetermined numerical values in the memories Q1 to Q4 corresponding to the second group of magnification setting keys 90 to 93.

It is to be noted here that the memories Q1 to Q4 and memories Q5 to Q8 corresponding to the first group of magnification setting keys 85 to 88 are set in the predetermined area in the RAM 352 in FIG. 9.

The numerical values to be preset in the memories Q1 to Q4 are those determined by the on or off state of switches following operation of the keys 95 and 96 shown in FIGS. 1 and 9, and more specifically, a worker turns on or off the switches 95 and 96 according to the combination preliminarily determined based on destinations and the like, during assembly of the apparatus or at a stage of shipping from a factory, thereby to preset predetermined values in the memories Q1 to Q4 through closing of an initial switch SW60 (FIG. 1).

Steps #204 to #207 show processes for setting the magnification numerical values with respect to the combinations of the on or off state of the switches 95 and 96 stored in the host CPU 301, in the respective memories Q1 to Q4 (steps #201 to #203). Specific examples of the preset values with respect to the combination of the on or off state of the switches 95 and 96 are given in Table 1 below.

TABLE 1

| Switches | | Magnifications | | | |
|---|---|---|---|---|---|
| 95 | 96 | Q1 | Q2 | Q3 | Q4 |
| 0 | 0 | 0.707 | 0.816 | 1.414 | 1.000 |
| 0 | 1 | 0.707 | 0.785 | 1.414 | 1.000 |
| 1 | 0 | 0.647 | 0.785 | 1.297 | 1.000 |
| 1 | 1 | 1.000 | 1.000 | 1.000 | 1.000 |

In the case where the numerical values as the copying magnifications are set as desired in the memories Q1 to Q8 corresponding to the selecting keys 90 to 93 or 85 to 88, processes as shown in FIGS. 17(*a*) through 19 are effected.

In FIG. 17(*a*) (steps #401 through #427), at steps #401 and #402, when the change-over is made to the copying magnification setting mode through operation of the key 89 or 94, it is judged for which of the first and second groups of keys the magnification setting is required. When key 89 is operated, the mode is the first copying magnification setting mode, and at step #403, "1" is set in a flag A, while, upon operation of key 94, "1" is set in a flag B indicating the second copying magnification setting mode at step #404.

When key 89 or 94 is operated, in both cases, at steps #405 to #408, it is processed to set the 1000th digit flag to "1", and the unit digit display to "0". In other words, when the control of the copying apparatus is changed over to the magnification setting mode, the numerical value display unit 52 displays "bbb0" (b for blank) so as to be in a stand-by state for accepting inputs from the figure of the 1000th digit.

When the ten-keys are operated in the above state, the kind of key is checked at step #410, and only in the case of the 1 key 61, the step proceeds to step #411 for displaying "1" at the 1000th digit. It is to be noted that, although the numerical values to be input are described here in the expressions as the 1000th digit, 100th digit, 10th digit and unit digit for convenience of explanation with respect to the numerical value display unit 52, the numerical values as magnifications are dealt with as decimal numerals having effective figures in four digits and calculated down to three places of decimals.

In the case where the numerical values to be input are 0 or 2 to 9 under the state in which the 1000th digit flag is "1", the step proceeds to step #413 for display of "0" at the 1000th digit. Subsequently, in the case where the input is 0, the step advances to step #412 in the similar manner as in 1 to set the 1000th digit flag to "0" and the 100th digit flag to "1" so as to wait for the input to the 100th digit figure. In the case where the input is of 2 to 9, the step proceeds to step #418 to display the input numerical value at the 100th digit figure.

The process as described above when the 1000th digit flag is "1", is based on an assumption that the numerical values in the range of 0.647 to 1.414 are treated as effective for copying magnifications, and accordingly, either 1 or 0 may be displayed on the 1000th digit figure. Moreover, by the above arrangement, the key operation in the case where 0 is input into the 1000th digit figure can be simplified. However, even when the process as described above is effected, there may possibly arise a case where the numerical value undesirably goes out of the range of the above effective copying magnifications depending on the numerical values input under the 100th digit. The process in such a case will be described later with respect to the sub-routine in FIGS. 17(*b*) and 18.

When a numerical value is applied to the 1000th digit figure, the 100th digit flag becomes "1", and upon operation of the ten-keys in the above state, the numerical value corresponding to the key operated for the 100th digit figure is input for displaying said numerical value at step #418, while the process for setting the 100th digit flag to "0" and the 10th digit flag to "1" is executed at step #419. Subsequently, the 10th digit input and unit digit input are also effected by the operation of the ten-keys.

The flow-chart of FIG. 17(*b*) (steps #430 through #458) shows the process for storing the numerical values input and displayed by the process of FIG. 17(*a*) into memories corresponding to the selecting keys to be subsequently operated.

At step #430, in the first place, judgement is made as to whether the mode is of the first magnification setting mode or the second magnification setting mode. Since step #430 is to be executed only when either of the flag A or B is "1", for example, only the judgement as to whether or not the flag A is "0" is effected here. If the flag A is "1", the mode is of the first magnification setting mode, and therefore, the step proceeds to steps after step #444 for judging the operation of the first group of selecting keys 85 to 88, while if the flag A is not "1", i.e., when the flag B is "1", the mode is of the second magnification setting mode, and therefore, the step proceeds to steps after step #431 for judging the operation of the second group of selecting keys 90 to 93.

In the process of FIG. 17(*b*), in any of the magnification setting modes, it is fundamentally effected to store the displayed numerical values in the memories corresponding to the operated selecting keys. However, at this stage, it is possible that numerical values not present in the range permitted as the copying magnifications are displayed. Accordingly, the arrangement is so made that a sub-routine shown at step #432 is effected subsequent to the judgement of operation of each key so that numerical values out of the allowable range may not be stored in the memories. The process at step #432 is shown in FIG. 18 (steps #460 through #464).

In FIG. 18, when the indication is not "0", it is discriminated at step #461 whether or not the displayed numerical value is smaller than 0.647, and if smaller, the display is changed to 0.647 at step #462. Meanwhile, at step #463, it is judged whether or not the displayed numerical value is larger than 1.414, and if larger, the display is changed to 1.414 at step #464.

Accordingly, in the explanation in association with the flow-chart of FIG. 17(*b*), upon operation of the predetermined selecting key in the magnification setting mode, the displayed numerical value is stored in the memory corresponding to the key, after correcting the display to the permitted limit value, if the displayed value is out of the allowable range. When the process for storing the numerical value in the memory is executed, the flag A is set to "0" in the first magnification setting mode and the flag B is set to "0" in the second magnification setting mode respectively, and the step advances to step #456.

Steps #456 through #458 show processes when the clear/stop key 81 (FIGS. 7 and 9) is operated. Upon depression of the clear/stop key 81, "bbb1" is displayed on the display unit 52 at steps #457 and #458, while the flags A and B are set to "0". In other words, when the clear/stop key 81 is operated, the displayed numerical value is cleared, while the magnification setting mode is released. Accordingly, the numerical value "1" displayed thereby is "1" as a standard set value of the number of copies to be taken.

FIGS. 19(*a*) and 19(*b*) respectively show processes to be effected upon operation of the second group of selecting keys 90 to 93 and the first group of selecting keys 85 to 88.

In FIG. 19(*a*) (steps #501 through #512), when any one of the keys 90, 91, 92 and 93 is operated, the light emitting diode corresponding to the operated key among the light emitting diodes 90*a*, 91*a*, 92*a* and 93*a* provided to correspond to the respective keys is lit, and subsequently, the numerical values stored in the memory is transferred to the optical system control CPU 304 as the magnification data.

In FIG. 19(*b*) (steps #513 through #528), when any one of the selecting keys 85 to 88 is operated, the corresponding light emitting diode is lit in the similar manner as above, while, since the magnification setting is arbitrarily made, the numerical values set in the corresponding memories Q5 to Q8 are displayed on the display unit 52 at steps #514 , #518, #522 and #526. The above display is effected, for example, only when the respective keys are being depressed, and it is so arranged that, upon releasing of the keys, the number of sheets to be copied set in the other memory device is called to be displayed on the display unit 52. In the case of the first group of selecting keys also, the numerical value stored in the memory corresponding to the operated key is transferred to the CPU 304 as the magnification data, whereby the CPU 304 for the optical system control applies control signals to the speed control circuit 356 and step motor driving control circuit 357 (FIG. 12) based on said magnification data, thus making it possible to effect the copying functions at the set copying magnification.

Reference is further made to flow-charts of FIGS. 20(*a*) and 20(*b*) (steps #601 through #622) showing details of the copying mode store routine.

At steps #601 and #602, the copying mode set indicating lamp 111*a* is lit at an ON edge of the copying mode setting key 111. Subsequently, at step #603, if the key 111 is turned ON during copying, the data for the copying mode then being executed at step #604 is saved in another memory. In this case, although the copying mode data is saved, the copying is continued to be effected based on the data thus saved. Thereafter, at step #605, the display on the control panel is brought into a state of an initial mode, which means the state in which the number of sheets displayed is 1, the exposure position is at the center, and the magnification is at 1:1, etc. In the actual practice, only the display on the control panel becomes the state of the initial mode, and displacement of the lens assembly, change-over of the paper feeding ports, etc. are not effected.

Subsequent to setting of the control panel to the initial mode, when the copying mode store key 112 is depressed after setting any desired copying mode, the copying mode set indicating lamp 111*a* is de-energized at step #602, and upon depression of any desired key of the ten-keys 61 to 70, with the store key 112 being kept depressed, the above set copying mode data are stored in the memory corresponding to the depressed key. For example, if the ten-key 70 is depressed, the data for the copying mode including the number of sheets to be copied, exposure position, ADF mode, paper size, and copying magnification are stored in addresses OA to OE of the memories at steps #604 to #608. Thereafter, by depressing any one of the ten-keys 61 to 69, the copying mode data are respectively stored in the memories 1A to 1E, . . . , and 9A to 9E (FIG. 20(*b*)). If the time at which the copying mode setting key 111 is depressed during the copying, the saved copying mode referred to earlier is restored at step #622.

Referring also to FIG. 21 (steps #701 through #713) showing details of the copying mode routine, at steps #701 and #702, when the copying at the previous copying mode is terminated, with the mode change-over signal set to "1" and the mode card indicative of the subsequent copying mode is read by the ADF unit, the mode of the copying apparatus is changed over to the copying mode preliminarily stored according to the mode code thereof. In the present embodiment, it is possible to set ten kinds of copying modes equivalent to 0 to 9 of the ten-keys, and for example, in the case where the mode code is zero, the data of the memory OA are set for the number of sheets to be copied, data of the memory OB are set for the exposure position, and data for the memory OC are set for the ADF mode respectively at steps #703 through #705. Moreover, at steps #706 through #708, copy paper sheets having a size for the data of the memory OD are searched for, and if present, the paper feeding port thereof is selected, while if such copy paper sheets are absent, the paper size indicating lamp therefor flickers. Furthermore, at steps #709 to #713, it is searched whether or not the same magnification as that in the memory OE is set in any of the memories for the eight magnification keys 85 through 93, and if set, the magnification key is selected, while on the contrary, if the same magnification is not set, the magnification set in the memory of the magnification key 88 is stored in the temporary save memory, and the magnification of the memory OE is set in the memory of the magnification key 88 for selection of said magnification key 88.

Referring further to FIG. 22 (steps #801 through #807), there are shown details of the auto-reset routine.

At step #801, when the auto-reset timer which starts time counting by the key input on the control panel or completion of the copying counts up, the display for the number of sheets to be copied is set to "1", exposure position is set to "center", and paper feeding port is selected to "lower paper feeding" respectively at steps #802 through #804, and if the magnification saving is effected at steps #805 through #807, the magnification is returned to the memory of the magnification key 88, and the magnification set by the magnification selecting key 93 is selected for the actual magnification.

Figure 23:
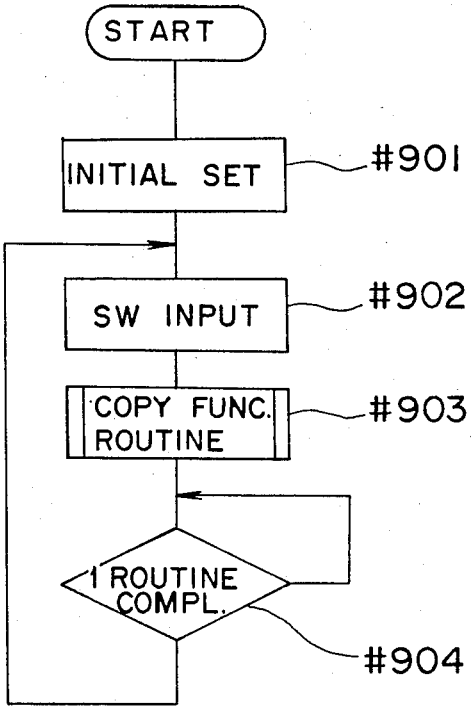
FIGS. 23 through 24(*b*) are flow-charts showing processing procedures of a master CPU (central processing unit)

FIG. 23 shows the process procedures (steps #901 through #904) for the master CPU 302.

Upon starting of the program, the initial settings of the CPU 302 and the copying apparatus are effected at step #901. Subsequently, at steps #902 and #903, the copying function routine is executed by the input of the print key. Thus, one routine is completed upon counting up by an internal timer of the CPU 302 at step #904.

Figure 24A:
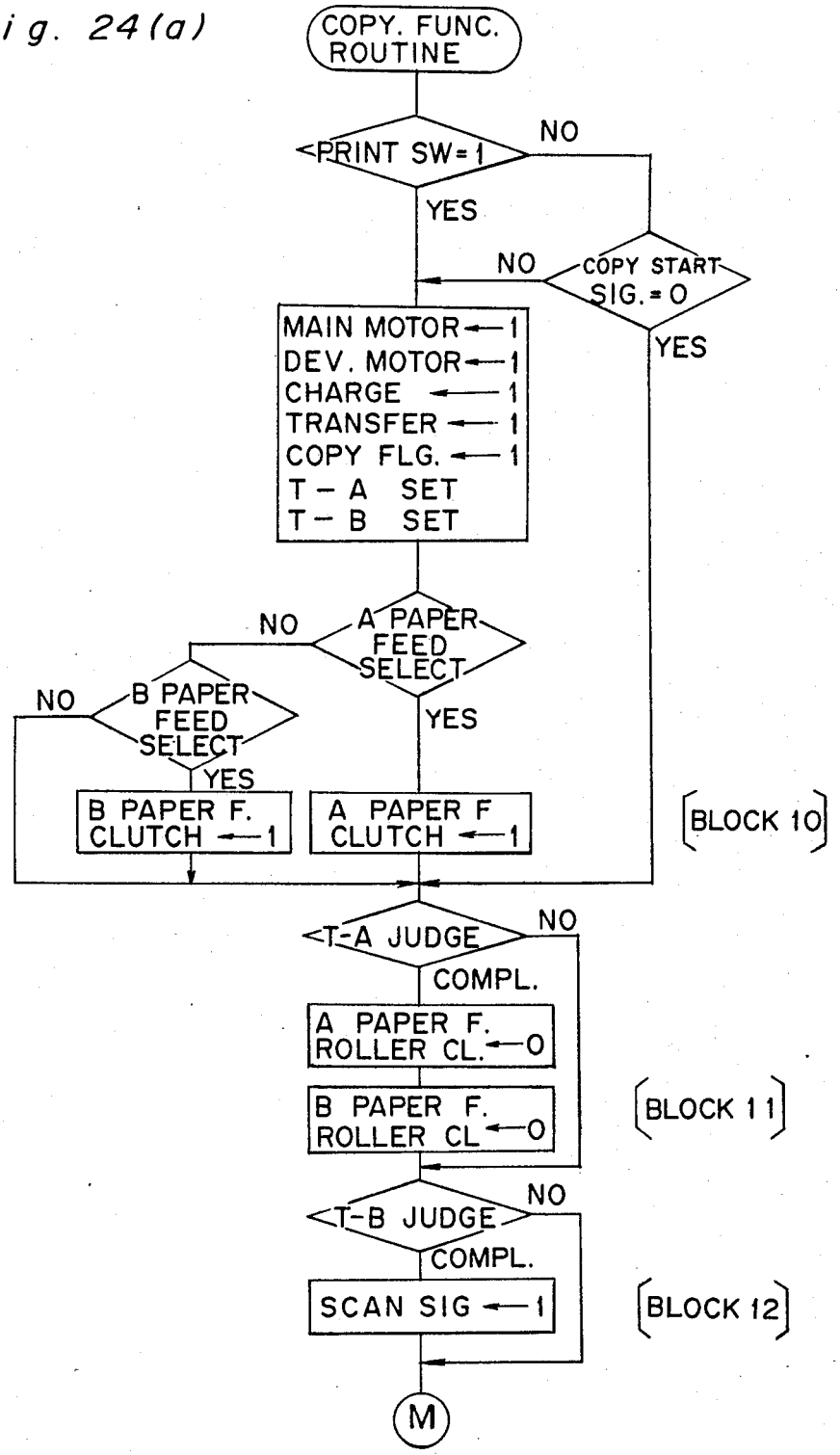
Figure 24B:
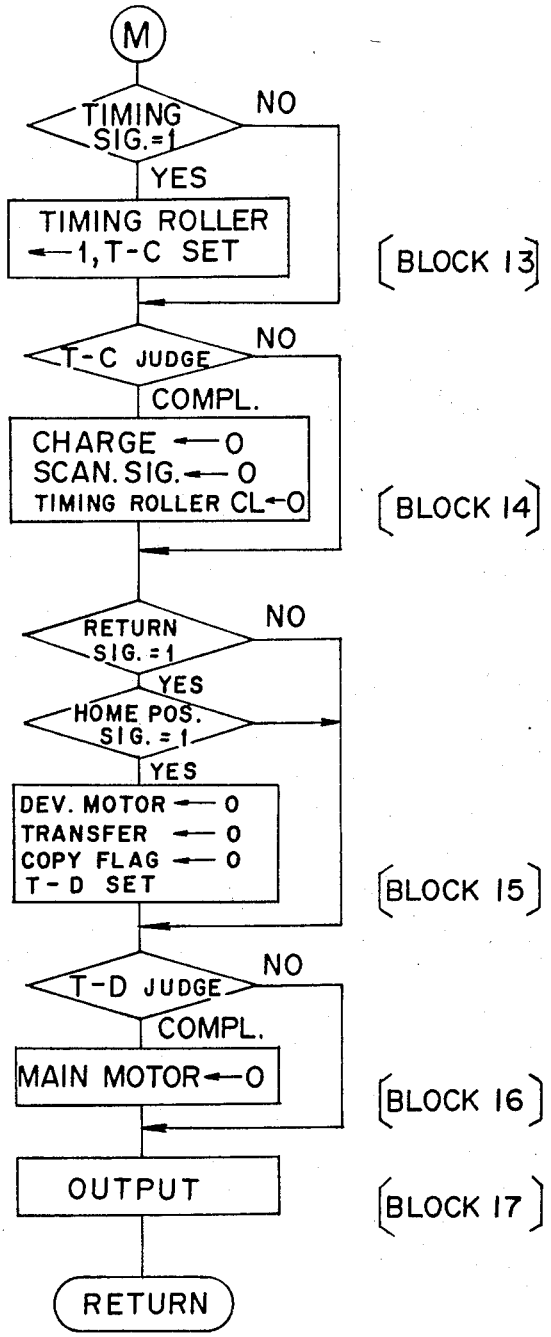

FIGS. 24(*a*) and 24(*b*) (blocks 10 through 17) show details of the copying function routine in the above step #903.

In a block 10, by the turning ON of the print switch or by a copy request signal becoming "1" upon setting of the original documents on the ADF unit 200, the main motor M1, developing motor M2, corona charger 12 and transfer charger 14 are respectively caused to function, while the copy flag indicating that the copying functions are being effected is set to "1", and timers T-A and T-B for the control are started, with the clutch of the paper feeding roller at the selected side being turned on.

At a block 11, completion of the timer T-A is checked to turn off the paper feeding clutch.

At a block 12, completion of the timer T-B is checked to turn on the scan motor M3 for starting the scanning function.

In a block 13, when the timing signal is produced during the scanning function, a process is effected to turn on the timing roller clutch CL3, and also to set the timer T-C. By the timing roller 35, the copy paper sheet is transported in synchronization with the image formed on the photosensitive surface 1*a* of the photoreceptor drum 1.

In a block 14, by judging the termination of the timer T-C, the corona charging, scan motor and timing roller clutch are respectively turned off. It is to be noted here that the timer T-C may be set to be variable according to sizes, etc. of the copy paper sheets employed.

In a block 15, when the optical system is returned to a home position, with a home position switch turned on, a process is effected to turn off the developing motor M2 and the transfer charger respectively, and also to set the timer T-D.

In a block 16, completion of the timer T-D is judged to turn off the main motor M1, while a block 17 effects processes for various outputs.

It should be noted here that the timers T-A through T-D, etc. are digital timers so programmed as to be counted up by "1" for each routine of the process of CPU 302 executed within the time period defined by internal timers, and the count-up time is memorized as the numerical data.

Figure 25:
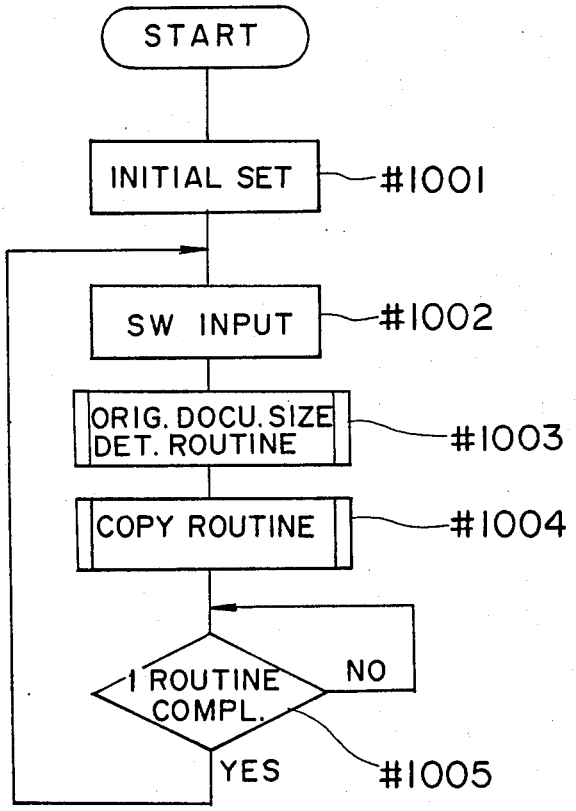
FIGS. 25 through 27 are flow-charts showing processing procedures of an ADF CPU (central processing unit)

Reference is also made to FIG. 25 (steps #1001 to #1005) showing process procedures of the ADFCPU 303.

At step #1001, initial settings of the CPU 303 and the ADF unit are effected, and upon input by the print key at step #1002, original document detecting routine and copying routine are executed respectively at steps #1003 and #1004. Thus, when the internal timer of the CPU 303 counts up at step #1005, one routine is completed.

Figure 26:
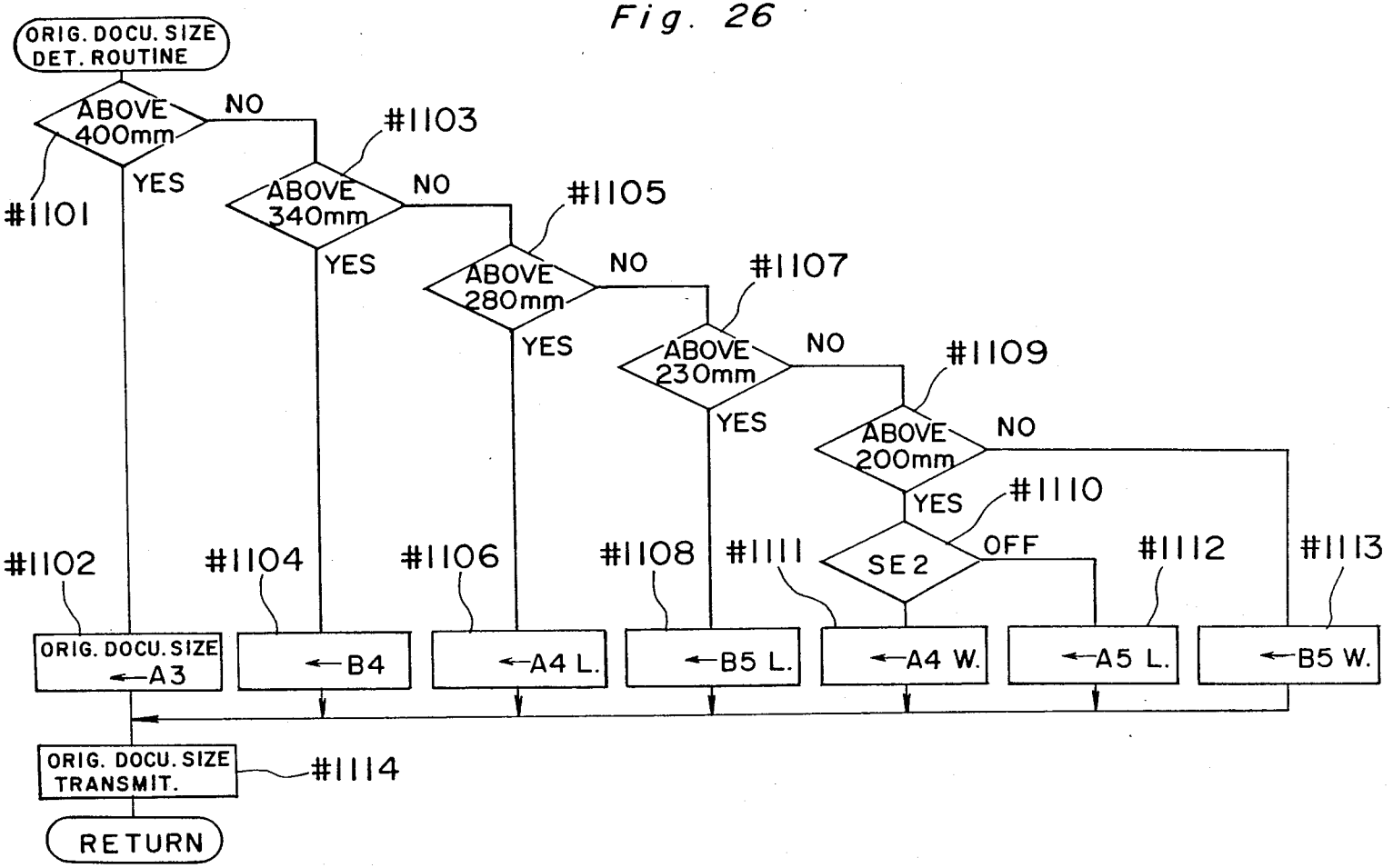

FIG. 26 (steps #1101 through #1113) shows details of the original document size detecting routine at step #1003 referred to above.

The original document length sensor SE1 provided on the passage of original documents for the ADF unit detects the length of the original document by the time required for the original document to pass therethrough, while the original document width sensor SE2 detects the width of the original document, and thus, the size of the original document is detected based on the combination of the length and width. The size of the original document thus detected is transmitted to the host CPU 301 and the master CPU 302 by a communication bus.

Figure 27:
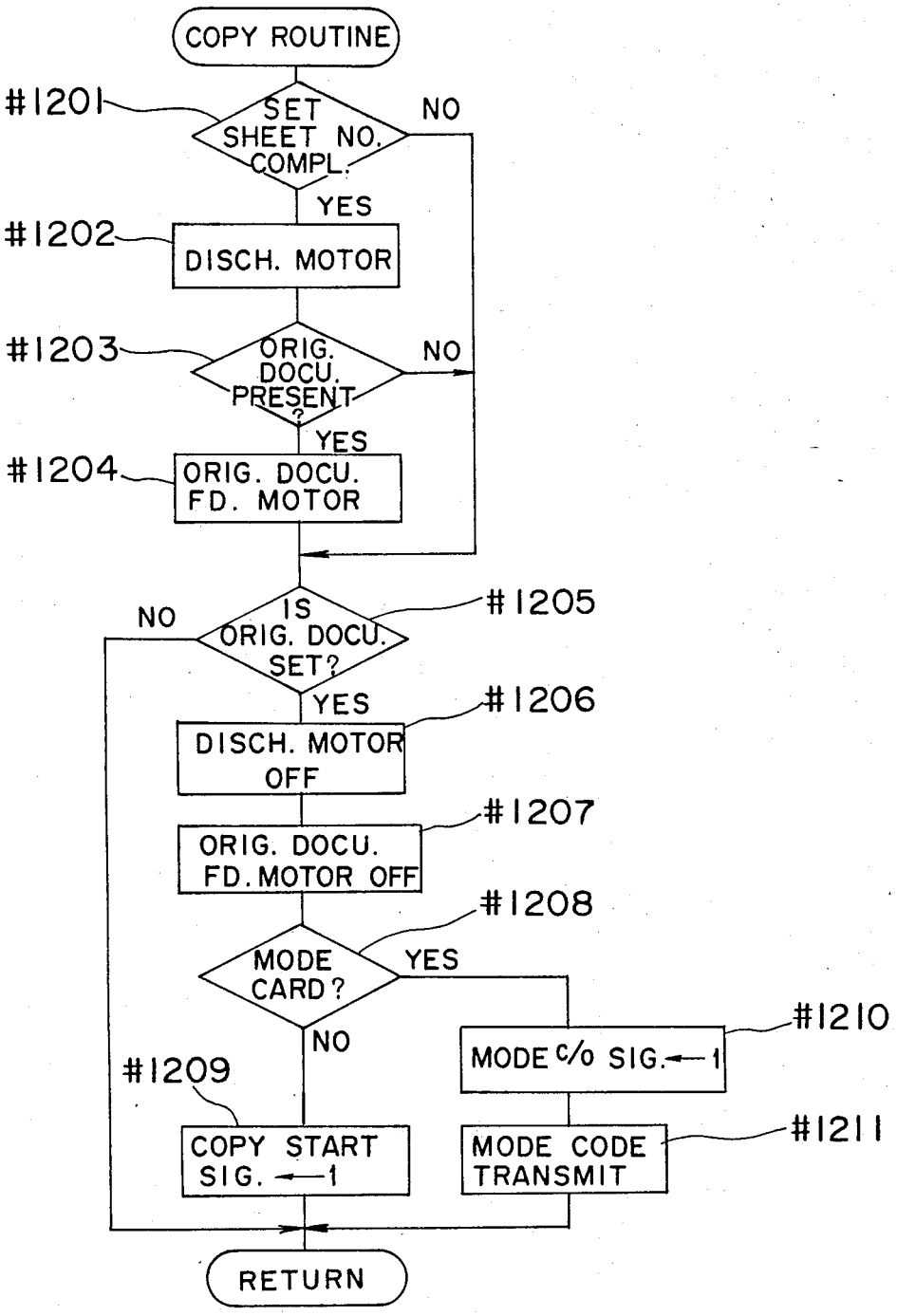

FIG. 27 (steps #1201 through #1211) shows details of the copying routine at step #1004 described above.

At steps #1201 and #1202, when copying has been completed for the number of sheets set with respect to a certain original document, the original document discharge motor 255 is turned on. Meanwhile, at step #1203 and #1204, if any original document is present at the original document set portion, the original document feeding motor 256 is turned on. Subsequently, at steps #1205 to #1207, when the fed original document is set on the transparent original document platform, the original document discharge motor 255 and the original document feeding motor 256 are turned off. Subsequently, at steps #1208 to #1211, it is discriminated whether the original document now fed is a real original document or a mode card, and if it is the actual original document, the copy starting signal is set to #1, while if it is a mode card, the change-over signal is set to "1", so as to feed the read mode code to the master CPU 302.

Figure 28:
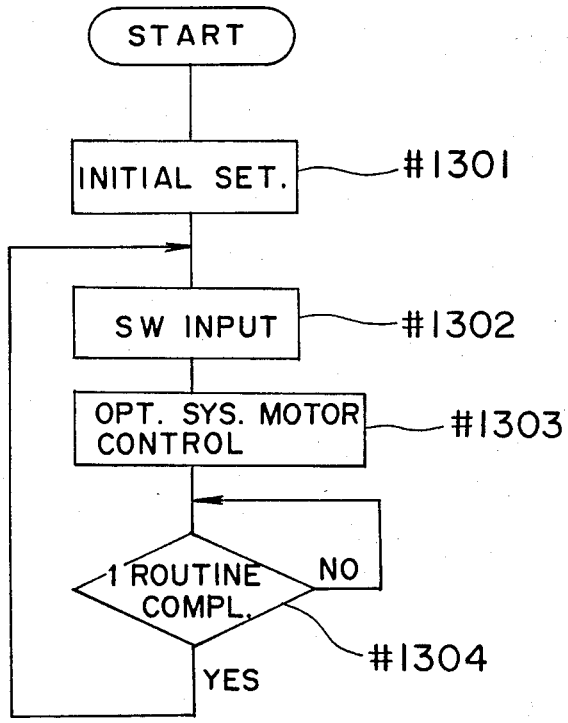
FIG. 28 is a flow-chart showing processing procedures of an optical system CPU (central processing unit)

FIG. 28 (steps #1301 through #1304) shows process procedures for the optical system CPU 304.

At step #1301, initial settings of the CPU 304 and the control device of the optical system 10 are effected, and upon input by the print key at step #1302, control of the motor M3 for driving the optical system is effected at step #1303. Thus, when the internal timer of the CPU 304 counts up at step #1304, one routine is completed. Since the control method of the optical system driving motor M3 is not directly related to the present invention, detailed description thereof is abbreviated here for brevity.

Figure 29:
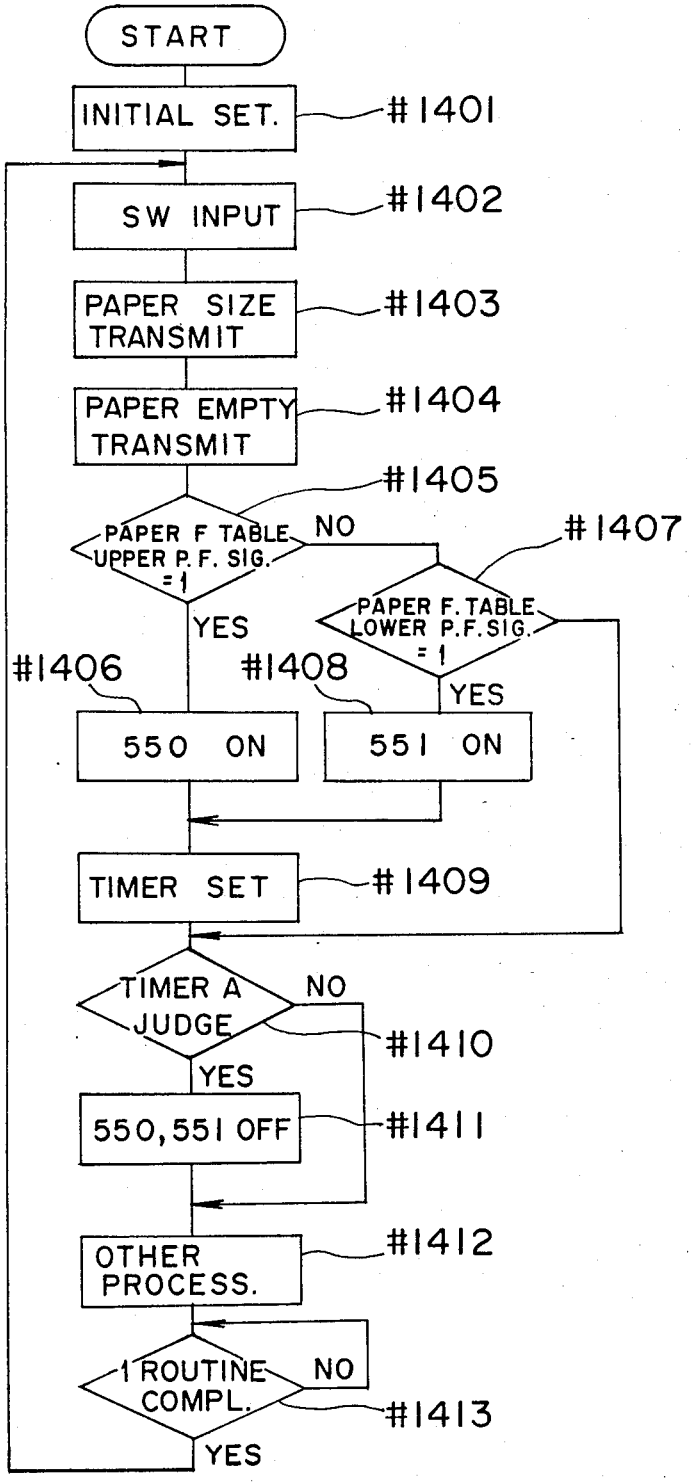
FIG. 29 is a flow-chart showing processing procedures of a paper feeding unit CPU (central processing unit)

FIG. 29 (steps #1401 through #1413) shows process procedures of the paper feeding CPU 305.

At step #1401, initial settings of the CPU 305 and the paper feeding unit 500 are effected. Subsequently, at step #1402, upon input by the print key, processes for transmitting the signal representing the paper sizes for the upper paper feeding port and the lower paper feeding port, and the signal indicating whether or not the state is of "paper empty" are effected at steps #1403 and #1404. Thus, at steps #1405 to #1408, if the paper feeding table upper paper feeding signal is "1", the upper paper feeding clutch 550 is turned on, while when the paper feeding table lower paper feeding signal is "1", the lower paper feeding clutch 551 is turned on. Furthermore, at step #1409, the timer A is set, and upon counting up by the timer A at step #1410, the clutches 550 and 551 are turned off at step #1411. Thus, at step #1412, other processes are effected, and by waiting for the internal timer of the CPU 305 to count up at step #1413, one routine is completed.

Figure 30:
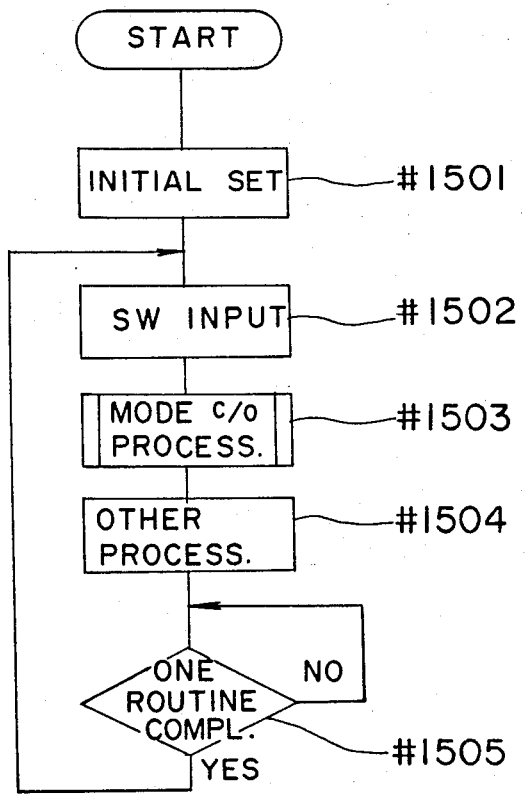
FIGS. 30 and 31 are flow-charts showing processing procedures of a sorter CPU (central processing unit).

FIG. 30 (steps #1501 through #1505) shows process procedures of the sorter CPU 306.

At step #1501, initial settings of the CPU 306 and the sorter 600 are effected. Subsequently, upon input by the print key at step #1502, the mode change-over process routine is executed at step #1503, while other processes are effected at steps #1504 and 1505, and one routine is completed by waiting for the internal timer of the CPU 306 to count up.

Figure 31:
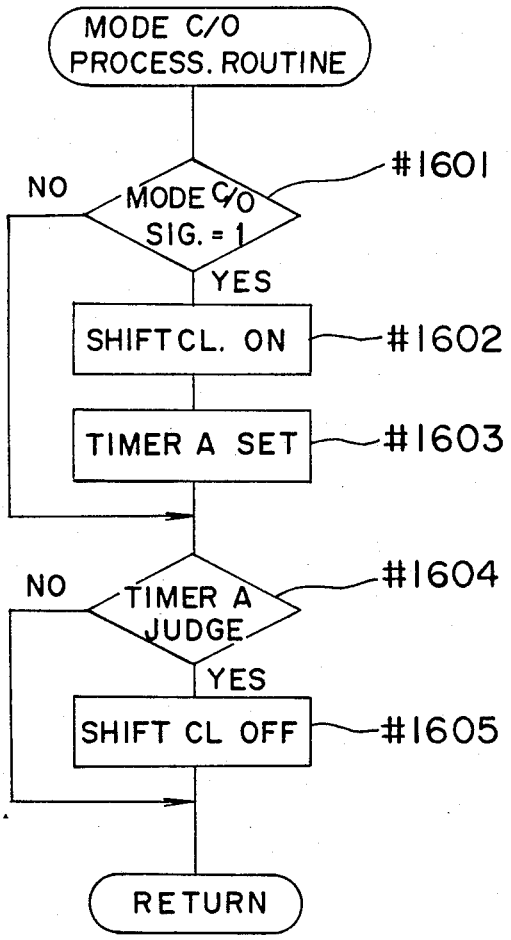

Referring finally to FIG. 31 (steps #1601 through #1605) shows details of the mode change-over process routine at step #1503 referred to earlier. Upon judgement that the mode change-over signal is "1" at step #1601, the shift clutch 601 is turned on, with the timer A set at steps #1602 and #1603. Thus, at steps #1604 and #1605, when the timer A counts up, the shift clutch 601 is turned off. By the above process, it is so arranged that, when the copying mode is altered while the copying is being effected, the discharge position of the copy paper sheets to the sorter 600 is deviated by the shift clutch 601 so that the copy paper sheets in the previous copying mode may not be mixed with the copy paper sheets in the present copying mode. Moreover, in the case where there is a deviation in timing between the actual mode change-over signal and the discharge of the last copy in the previous mode, it is possible to make an adjustment, for example, by delaying the timing of the mode change-over signal output. For other processes for steps #1504 in FIG. 30, there are such processes as the change-over of the bins of the sorter 600.

As is clear from the foregoing description, according to the present invention, since the data sheet is adapted to have the mark for the code identification for the operator and the set data for the mode reservation of the copying function are arranged to be input by the use of keys on the control panel, the work required in writing in the data sheet becomes unnecessary, and thus, the mode reservation is effected in a simple manner, while the data reading mechanism for the automatic original feeding unit can also be simplified.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. In copying apparatus on which an automatic original document feeding device can be removably mounted for copying an original document the improvement comprising;

an original document identification sheet marked with an identification code symbol and capable of being transported by said automatic original document feeding device;

a sensor provided on said automatic original document feeding device for reading the identification code symbol marked on said original document identification sheet;

means for judging the existence of a predetermined code from the identification code symbol read by said sensor;

a memory means for storing a plurality of sets of predetermined data, each including information corresponding to said predetermined code and also a functioning mode data set capable of enabling the copying function;

a first operating means for permitting the user to manually input said code into said memory means;

a second operating means for permitting the user to manually input said functioning mode data into said memory means in correlation with the code symbol; and a control means arranged to control the copying apparatus wherein when the original document identification sheet is transported by the automatic original document feeding device so that said identification code symbol is read by the sensor, and the code corresponding to said identification symbol is verified by said judging means, said control means is enabled to read the functioning mode data stored together with said code from said memory means for controlling the copying apparatus to execute the copying function based on said read functioning data.

2. A copying apparatus as claimed in claim 1, further including a memory mode setting operating means for enabling said code and said functioning mode data to be stored in said memory means, whereby said code and data are stored in said memory means, only when the memory mode has been set by said memory mode setting operating means.

3. A copying apparatus as claimed in claim 1, further including means for varying copying magnifications, and means for storing a plurality of copying magnification data, whereby, when the code is judged as the sheet is transported and the functioning mode data corresponding thereto is read out, the copying magnification data included in said read out functioning mode data and said stored copying magnification data are compared with each other, and in the absence of data coinciding with said stored copying magnification data, the copying magnification data in said read out functioning mode data are stored in said copying magnification memory means.

4. A copying apparatus as claimed in claim 1, further including an automatic paper sorter with storage bins for classifying the copy paper sheets to be discharged from said copying apparatus, and means for providing a control signal for the control means to said automatic paper sorter whereby when the copying apparatus functioning mode is altered upon judgement of a code, as said identification sheet is transported into the copying apparatus, the control signal is output to said sorter so as to alter the position of said storage bins into which the copy paper sheets are discharged.

5. In a copying apparatus having optimal copying operations such as paper size, magnification and the like, an original document feeder for feeding documents to be copied, a control panel for displaying controls to effect the copying operation and means for initiating a copying operation employing a first sequence of copying operations, the improvement comprising:

means for permitting an operator to manually set and store at least a second predetermined sequence of copying operations on the control panel, the operator being capable of subjectively composing the programmed sequence of copying operations on the control panel relative to a code indicia, including a mode setting key to enable the control panel to assume a state of setting the copying operation and a store memory key to store data to enable the desired copying operations which are maintained in storage during the implementation of the first sequence of copying operations;

sensor means associated with the document feeder to determine the halting of the first sequence of copying operations and to address the storage of the second sequence of copying operations data in response to an identification of data on a document corresponding to the code indicia; and means for implementing the second sequence of copying operations as preset in storage by the operator.

6. The invention of claim 5 further including means for automatically correcting any pre-set magnification from the control panel entered by the store memory key beyond the magnification ratio of the copying apparatus to a magnification ratio within the copying range of the copying apparatus.

7. The invention of claim 6 further including a copy paper sorter apparatus and means for automatically separating copier paper in the sorter apparatus when a copying mode is altered.

8. In a copying apparatus having optimal copying operations such as paper size, magnification and the like, an original document feeder for feeding documents to be copied, a control panel for displaying controls to effect the copying operation and means for initiating a copying operation employing a first sequence of copying operations, the improvement comprising:

means for permitting an operator to manually set and store at least a second predetermined sequence of copying operations on the control panel, the operator being capable of subjectively composing the programmed sequence of copying operations on the control panel relative to a code indicia, including a mode setting key to enable the control panel to assume a state of setting the copying operation and a store memory key to store data to enable the desired copying operations which are maintained in storage during the implementation of the first sequence of copying operations;

sensor means associated with the document feeder to address the storage of the second sequence of copying operations data in response to an identification of data on a document corresponding to the code indicia;

an automatic paper sorter with storage bins;

control means for controlling the copying apparatus in reponse to the stored data retrieved from memory; and means for automatically separating copier paper in the sorter apparatus when a copying mode is altered.

* * * * *